US005607341A

United States Patent [19]

Leach

[11] Patent Number: 5,607,341

[45] Date of Patent: Mar. 4, 1997

[54] METHOD AND STRUCTURE FOR POLISHING A WAFER DURING MANUFACTURE OF INTEGRATED CIRCUITS

[76] Inventor: Michael A. Leach, 345 Sheridan #204, Palo Alto, Calif. 94306

[21] Appl. No.: 287,639

[22] Filed: Aug. 8, 1994

[51] Int. Cl.[6] ..... B24B 1/00

[52] U.S. Cl. ..... 451/41; 451/287; 451/285

[58] Field of Search ..... 451/287, 285, 451/289, 278, 533, 41, 259, 288, 526, 529, 539, 165, 273, 553, 290, 463, 481

[56] References Cited

U.S. PATENT DOCUMENTS

| | | | |
|---|---|---|---|
| 653,531 | 7/1900 | Richmond et al. . | |
| 1,513,813 | 11/1924 | Hill et al. . | |
| 1,899,463 | 2/1933 | Howard . | |
| 2,405,417 | 8/1946 | Fruth | 51/145 |
| 2,493,206 | 1/1950 | Okey | 51/134 |
| 2,530,530 | 11/1950 | Littlefield | 51/195 |
| 2,536,444 | 1/1951 | Hamilton | 51/80 |
| 2,687,603 | 8/1954 | White | 51/283 |
| 2,733,562 | 2/1956 | Drummond | 51/267 |
| 2,869,294 | 1/1959 | Boettcher et al. | 51/266 |
| 2,992,519 | 7/1961 | Pearson | 51/129 |
| 2,998,680 | 9/1961 | Lipkins | 51/131 |
| 3,032,937 | 5/1962 | Day et al. | 51/128 |
| 3,050,910 | 8/1962 | Lichtenfeld | 51/129 |
| 3,063,206 | 11/1962 | Meyerhoff et al. | 51/161 |
| 3,093,937 | 6/1963 | Balamuth et al. | 51/67 |
| 3,110,988 | 11/1963 | Boettcher | 51/131 |
| 3,111,791 | 11/1963 | Harris et al. | 51/129 |
| 3,150,401 | 9/1964 | Taylor et al. | 15/311 |
| 3,292,312 | 12/1966 | Snyder | 51/281 |
| 3,304,662 | 2/1967 | Boettcher | 51/131 |
| 3,374,582 | 3/1968 | Boettcher | 51/131 |
| 3,535,830 | 10/1970 | Keefe et al. | 51/217 |
| 3,559,346 | 2/1971 | Paola | 51/57 |

(List continued on next page.)

FOREIGN PATENT DOCUMENTS

| | | | |
|---|---|---|---|
| 0623423A1 | 11/1994 | European Pat. Off. . | |
| 361257749 | 11/1986 | Japan | 451/285 |
| 403184762 | 8/1991 | Japan | 451/259 |
| 403221368 | 9/1991 | Japan | 451/290 |
| 0621505 | 2/1981 | Switzerland | 451/289 |

OTHER PUBLICATIONS

Toshiyasa Beppu et al., "A New Pad And Equipment Development For ILD Planarization," Semiconductor World, Jan., 1994, MY Mar. 17, 1994, 11 pages.

Scott R. Runnels, "Feature-Scale Fluid-Based Erosion Modeling For Chemical-Mechanical Polishing," Sematech Technology Transfer #93102045A-ER, pp. 1-14.

(List continued on next page.)

*Primary Examiner*—D. S. Meislin
*Assistant Examiner*—Derris Banks
*Attorney, Agent, or Firm*—Skjerven, Morrill, MacPherson, Franklin & Friel; Alan H. MacPherson; Omkar K. Suryadevara

[57] ABSTRACT

A number of blocks are reciprocably supported in a polishing apparatus in accordance with this invention, entirely independent of each other so that lifting motion of one block is not transferred to an adjacent block, thus providing flexibility to follow the global curvature of the wafer. The polishing apparatus uses a block of a very hard design to ensure minimal deflection of the block into the microstructure of the wafer. Each block removes a portion of the wafer using relative motion between the block and the wafer. Each block is supported by at least three regions of the wafer during the relative motion, wherein each of the regions has the slowest rate of material removal in a die enclosing that region. In one embodiment, the smallest dimension of a block is approximately three times the size of the side of a die. The three point support and hard design of the blocks ensure local polishing removal uniformity while the independent support of the blocks ensures global uniformity, thus achieving an advantage over the conventional polishing process and apparatus.

16 Claims, 11 Drawing Sheets

U.S. PATENT DOCUMENTS

| | | | |
|---|---|---|---|
| 3,579,916 | 5/1971 | Boettcher | 51/131 |
| 3,579,917 | 5/1971 | Boettcher | 51/131 |
| 3,603,042 | 9/1971 | Boettcher | 51/131 |
| 3,611,654 | 10/1971 | Weber et al. | 51/266 |
| 3,628,291 | 12/1971 | Visconti | 51/148 |
| 3,631,634 | 1/1972 | Weber | 51/131 |
| 3,684,466 | 8/1972 | Petrone | 51/298 |
| 3,685,213 | 8/1972 | Rampe | 51/163 |
| 3,691,694 | 9/1972 | Goetz et al. | 51/80 |
| 3,699,722 | 10/1972 | Davidson et al. | 51/283 |
| 3,731,435 | 5/1973 | Boettcher et al. | 51/129 |
| 3,748,677 | 7/1973 | Frank et al. | 15/21 D |
| 3,813,825 | 6/1974 | Weber et al. | 51/129 |
| 3,823,515 | 7/1974 | Coes, Jr. | 51/322 |
| 3,838,542 | 10/1974 | Hodges | 51/119 |
| 3,863,394 | 2/1975 | Dumentat | 51/109 R |
| 3,888,053 | 6/1975 | White et al. | 51/281 SF |
| 3,906,678 | 9/1975 | Roth | 51/154 |
| 3,998,673 | 12/1976 | Chow | 148/175 |
| 4,009,540 | 3/1977 | Uijen | 51/283 |
| 4,010,583 | 3/1977 | Highberg | 51/284 |
| 4,079,109 | 3/1978 | Nigh et al. | 428/636 |
| 4,085,549 | 4/1978 | Hodges | 51/119 |
| 4,132,037 | 1/1979 | Bonora | 51/131 C |
| 4,141,180 | 2/1979 | Gill, Jr. et al. | 51/5 R |
| 4,144,099 | 3/1979 | Edmonds et al. | 148/1.5 |
| 4,193,226 | 3/1980 | Gill, Jr. et al. | 51/124 R |
| 4,194,324 | 3/1980 | Bonora et al. | 51/131.5 |
| 4,195,323 | 3/1980 | Lee | 360/113 |
| 4,208,760 | 6/1980 | Dexter et al. | 15/302 |
| 4,239,567 | 12/1980 | Winings | 156/154 |
| 4,256,535 | 3/1981 | Banks | 156/645 |
| 4,258,508 | 3/1981 | Wilson et al. | 51/283 R |
| 4,270,314 | 6/1981 | Cesna | 51/131.4 |
| 4,276,114 | 6/1981 | Takano et al. | 156/645 |
| 4,313,284 | 2/1982 | Walsh | 51/131.4 |
| 4,321,284 | 3/1982 | Yakushiji | 427/89 |
| 4,321,641 | 3/1982 | Lee | 360/126 |
| 4,328,462 | 5/1982 | Jensen | 324/229 |
| 4,373,991 | 2/1983 | Banks | 156/645 |
| 4,393,628 | 7/1983 | Ottman et al. | 51/281 SF |
| 4,410,395 | 10/1983 | Weaver et al. | 156/662 |
| 4,412,886 | 11/1983 | Sakaguchi et al. | 156/645 |
| 4,417,945 | 11/1983 | Komatsuzaki | 156/639 |
| 4,435,247 | 3/1984 | Basi et al. | 156/636 |
| 4,450,652 | 5/1984 | Walsh | 51/131.4 |
| 4,466,218 | 8/1984 | Ottman et al. | 51/395 |
| 4,471,579 | 9/1984 | Bovensiepen | 51/165.73 |
| 4,489,484 | 12/1984 | Lee | 29/603 |
| 4,492,717 | 1/1985 | Pliskin et al. | 427/96 |
| 4,498,258 | 2/1985 | Ishimura | 51/131.3 |
| 4,512,113 | 4/1985 | Budinger | 51/236 |
| 4,520,596 | 6/1985 | Otto et al. | 51/55 |
| 4,524,127 | 6/1985 | Kane | 430/321 |
| 4,554,717 | 11/1985 | Vig et al. | 29/25.35 |
| 4,579,760 | 4/1986 | Hause et al. | 428/66 |
| 4,588,473 | 5/1986 | Hisatomi et al. | 156/645 |
| 4,593,495 | 6/1986 | Kawakami et al. | 51/118 |
| 4,607,496 | 8/1986 | Nagaura | 62/64 |
| 4,653,231 | 3/1987 | Cronkhite et al. | 51/5 R |
| 4,665,658 | 5/1987 | Carcey | 51/120 |
| 4,667,446 | 5/1987 | Imahashi | 51/229 |
| 4,671,851 | 6/1987 | Beyer et al. | 156/645 |
| 4,680,893 | 7/1987 | Cronkhite et al. | 51/5 R |
| 4,685,937 | 8/1987 | Hori et al. | 51/309 |
| 4,692,223 | 9/1987 | Lampert et al. | 204/34.5 |
| 4,708,891 | 11/1987 | Ito et al. | 427/245 |
| 4,722,130 | 2/1988 | Kimura et al. | 29/413 |
| 4,748,775 | 6/1988 | Imahashi | 51/229 |
| 4,753,838 | 6/1988 | Kimura et al. | 428/91 |
| 4,775,550 | 10/1988 | Chu et al. | 427/38 |
| 4,776,087 | 10/1988 | Cronin et al. | 29/828 |
| 4,789,648 | 12/1988 | Chow et al. | 437/225 |
| 4,793,895 | 12/1988 | Kaanta et al: | 156/627 |
| 4,811,522 | 3/1989 | Gill, Jr. | 51/131.1 |
| 4,854,083 | 8/1989 | Ishizuka et al. | 51/131.4 |
| 4,874,463 | 10/1989 | Koze et al. | 156/645 |
| 4,875,309 | 10/1989 | Long, III | 51/419 |
| 4,879,257 | 11/1989 | Patrick | 437/195 |
| 4,879,258 | 11/1989 | Fisher | 451/285 |
| 4,889,493 | 12/1989 | Otsuki et al. | 437/265 |
| 4,889,586 | 12/1989 | Noguchi et al. | 156/636 |
| 4,907,062 | 3/1990 | Fukushima | 375/75 |
| 4,907,371 | 3/1990 | Shoda et al. | 51/33 R |
| 4,910,155 | 3/1990 | Cote et al. | 437/8 |
| 4,916,868 | 4/1990 | Wittstock | 51/281 R |
| 4,918,870 | 4/1990 | Torbert et al. | 51/131.3 |
| 4,934,102 | 6/1990 | Leach et al. | 51/50 R |
| 4,934,103 | 6/1990 | Campergue et al. | 51/59 SS |
| 4,940,507 | 7/1990 | Harbarger | 156/636 |
| 4,944,119 | 7/1990 | Gill, Jr. et al. | 51/215 R |
| 4,944,836 | 7/1990 | Beyer et al. | 156/645 |
| 4,954,141 | 9/1990 | Takiyama et al. | 51/296 |
| 4,956,022 | 9/1990 | Mahmoud | 134/41 |
| 4,956,313 | 9/1990 | Cote et al. | 437/203 |
| 4,960,485 | 10/1990 | Ichinose et al. | 156/556 |
| 4,973,563 | 11/1990 | Prigge et al. | 437/225 |
| 4,974,370 | 12/1990 | Gosis | 51/111 R |
| 4,985,990 | 1/1991 | Cronin et al. | 29/852 |
| 4,986,035 | 1/1991 | Lambot | 51/109 R |
| 4,989,345 | 2/1991 | Gill, Jr. | 34/58 |
| 4,992,135 | 2/1991 | Doan | 156/636 |
| 5,020,283 | 6/1991 | Tuttle | 51/209 DL |
| 5,032,544 | 7/1991 | Ito et al. | 437/228 |
| 5,036,015 | 7/1991 | Sandhu et al. | 437/8 |
| 5,036,630 | 8/1991 | Kaanta et al. | 51/283 R |
| 5,038,524 | 8/1991 | Moulin | 51/209 R |
| 5,044,128 | 9/1991 | Nakano | 51/313 |
| 5,051,378 | 9/1991 | Yagi et al. | 437/225 |
| 5,055,158 | 10/1991 | Gallagher et al. | 156/643 |
| 5,069,002 | 12/1991 | Sandhu et al. | 51/165 R |
| 5,071,785 | 12/1991 | Nakazato et al. | 437/62 |
| 5,071,792 | 12/1991 | Van Vonno et al. | 437/227 |
| 5,073,518 | 12/1991 | Doan et al. | 437/180 |
| 5,077,234 | 12/1991 | Scoopo et al. | 437/67 |
| 5,078,801 | 1/1992 | Malik | 134/29 |
| 5,081,421 | 1/1992 | Miller et al. | 324/671 |
| 5,081,733 | 1/1992 | Kudo | 15/77 |
| 5,081,796 | 1/1992 | Schultz | 51/165.74 |
| 5,084,419 | 1/1992 | Sakao | 437/228 |
| 5,094,037 | 3/1992 | Hakomori et al. | 51/165.77 |
| 5,095,661 | 3/1992 | Gill, Jr. et al. | 51/131.3 |
| 5,096,854 | 3/1992 | Saito et al. | 437/225 |
| 5,097,630 | 3/1992 | Maeda et al. | 51/50 R |
| 5,101,602 | 4/1992 | Hashimoto | 51/216 LP |
| 5,104,828 | 4/1992 | Morimoto et al. | 437/225 |
| 5,110,428 | 5/1992 | Prigge et al. | 204/129.3 |
| 5,114,875 | 5/1992 | Baker et al. | 437/62 |
| 5,123,218 | 6/1992 | Karlsrud | 51/281 SF |
| 5,127,196 | 7/1992 | Morimoto et al. | 51/165.73 |
| 5,128,281 | 7/1992 | Dyer et al. | 437/225 |
| 5,131,110 | 7/1992 | Hadgis | 15/88.3 |
| 5,131,979 | 7/1992 | Lawrence | 156/655 |
| 5,132,617 | 7/1992 | Leach et al. | 324/207.16 |
| 5,137,544 | 8/1992 | Medellin | 51/308 |
| 5,139,571 | 8/1992 | Deal et al. | 106/3 |
| 5,144,711 | 9/1992 | Gill, Jr. et al. | 15/97.1 |
| 5,152,857 | 10/1992 | Ito et al. | 156/153 |
| 5,157,876 | 10/1992 | Medellin | 51/281 R |
| 5,157,877 | 10/1992 | Hashimoto | 51/283 R |
| 5,169,491 | 12/1992 | Doan | 156/636 |
| 5,177,908 | 1/1993 | Tuttle | 51/283 R |

| | | | |
|---|---|---|---|
| 5,181,342 | 1/1993 | Haney | 51/60 |
| 5,181,985 | 1/1993 | Lampert et al. | 156/635 |
| 5,187,899 | 2/1993 | Rhoades | 51/59 SS |
| 5,187,901 | 2/1993 | Karslrud | 51/132 |
| 5,188,987 | 2/1993 | Ogino | 437/228 |
| 5,191,738 | 3/1993 | Nakazato et al. | 51/283 R |
| 5,193,316 | 3/1993 | Olmstead | 51/281 SF |
| 5,196,353 | 3/1993 | Sandhu et al. | 437/8 |
| 5,197,230 | 3/1993 | Simpfendorfer et al. | 51/165.77 |
| 5,197,999 | 3/1993 | Thomas | 51/298 |
| 5,203,119 | 4/1993 | Cole | 51/165.77 |
| 5,205,077 | 4/1993 | Wittstock | 51/165 R |
| 5,205,082 | 4/1993 | Shendon et al. | 51/283 R |
| 5,209,023 | 5/1993 | Bizer | 51/209 R |
| 5,212,910 | 5/1993 | Breivogel et al. | 51/398 |
| 5,213,655 | 5/1993 | Leach et al. | 156/627 |
| 5,216,842 | 6/1993 | Phillips | 51/125 |
| 5,216,843 | 6/1993 | Breivogel et al. | 51/131.1 |
| 5,217,566 | 6/1993 | Pasch et al. | 156/636 |
| 5,222,329 | 6/1993 | Yu | 51/165.77 |
| 5,225,358 | 7/1993 | Pasch | 437/33 |
| 5,226,758 | 7/1993 | Tanaka et al. | 406/86 |
| 5,226,930 | 7/1993 | Sasaki | 51/308 |
| 5,227,339 | 7/1993 | Kishii | 437/225 |
| 5,229,331 | 7/1993 | Doan et al. | 437/228 |
| 5,230,184 | 7/1993 | Bukhman | 51/283 R |
| 5,232,875 | 8/1993 | Tuttle et al. | 437/225 |
| 5,234,867 | 8/1993 | Schultz et al. | 437/225 |
| 5,234,868 | 8/1993 | Cote | 437/225 |
| 5,238,354 | 8/1993 | Volovich | 414/779 |
| 5,240,552 | 8/1993 | Yu et al. | 156/636 |
| 5,241,792 | 9/1993 | Naka et al. | 51/165.9 |
| 5,242,524 | 9/1993 | Leach et al. | 156/345 |
| 5,245,790 | 9/1993 | Jerbic | 51/121 |
| 5,245,794 | 9/1993 | Salugsugan | 51/165.74 |
| 5,245,796 | 9/1993 | Miller et al. | 451/41 |
| 5,246,525 | 9/1993 | Sato | 156/345 |
| 5,255,474 | 10/1993 | Gawa et al. | 51/131.1 |
| 5,257,478 | 11/1993 | Hyde et al. | 51/131.3 |
| 5,264,010 | 11/1993 | Brancaleoni et al. | 51/308 |
| 5,265,378 | 11/1993 | Rostoker | 51/165.75 |
| 5,267,418 | 12/1993 | Currie et al. | 51/216 R |
| 5,269,102 | 12/1993 | Wood | 51/209 DL |
| 5,270,241 | 12/1993 | Dennison et al. | 437/52 |
| 5,274,960 | 1/1994 | Karlsrud | 51/109 R |
| 5,276,999 | 1/1994 | Bando | 51/62 |
| 5,281,244 | 1/1994 | Wiand | 51/295 |
| 5,282,289 | 2/1994 | Hasegawa et al. | 15/21.1 |
| 5,283,208 | 2/1994 | Lorsung et al. | 437/228 |
| 5,283,989 | 2/1994 | Hisasue et al. | 51/410 |
| 5,287,658 | 2/1994 | Attanasio et al. | 51/56 R |
| 5,287,663 | 2/1994 | Pierce et al. | 51/401 |
| 5,290,396 | 3/1994 | Schoenborn et al. | 156/636 |
| 5,292,689 | 3/1994 | Cronin et al. | 437/228 |
| 5,297,361 | 3/1994 | Baldy et al. | 51/119 |
| 5,297,364 | 3/1994 | Tuttle | 51/209 R |
| 5,298,110 | 3/1994 | Schoenborn et al. | 156/626 |
| 5,299,393 | 4/1994 | Chandler et al. | 51/272 |
| 5,301,471 | 4/1994 | Fisher et al. | 51/170 MT |
| 5,302,233 | 4/1994 | Kim et al. | 156/636 |
| 5,303,511 | 4/1994 | Tsuchiya et al. | 51/165.75 |
| 5,305,554 | 4/1994 | Emken et al. | 51/7 |
| 5,305,555 | 4/1994 | Luedeke et al. | 51/145 T |
| 5,307,593 | 5/1994 | Lucker et al. | 51/281 SF |
| 5,317,778 | 6/1994 | Kudo et al. | 15/88.3 |
| 5,320,706 | 6/1994 | Blackwell | 156/636 |
| 5,325,636 | 7/1994 | Attanasio et al. | 51/165.9 |
| 5,329,732 | 7/1994 | Karlsrud et al. | 51/131.5 |
| 5,332,467 | 7/1994 | Sune et al. | 156/636 |
| 5,335,453 | 8/1994 | Baldy et al. | 51/67 |
| 5,335,457 | 8/1994 | Matsuda et al. | 51/284 R |
| 5,337,015 | 8/1994 | Lustig et al. | 324/671 |
| 5,340,370 | 8/1994 | Cadien et al. | 51/308 |
| 5,341,602 | 8/1994 | Foley | 51/2 R |
| 5,341,608 | 8/1994 | Mains, Jr. | 51/320 |
| 5,345,639 | 9/1994 | Tanoue et al. | 15/88.2 |
| 5,350,428 | 9/1994 | Leroux et al. | 29/25.01 |
| 5,361,545 | 11/1994 | Nakamura | 451/287 |
| 5,423,558 | 6/1995 | Koeth et al. | 279/3 |
| 5,433,651 | 7/1995 | Lustig et al. | 451/6 |
| 5,435,772 | 7/1995 | Yu | 451/63 |
| 5,439,551 | 8/1995 | Meikle et al. | 156/626.1 |
| 5,442,828 | 8/1995 | Lutz | 15/88.3 |
| 5,443,416 | 8/1995 | Volodarsky et al. | 451/388 |

OTHER PUBLICATIONS

"Development of a Polishing Robot for Free Form Surface", Masanori Kunieda, Takeo Nakagawa, Toshiro Higuchi, Proceedings of the 5th International Conference on Production Engineering, Tokyo, 1984, pp. 265–270.

"Semi–Empirical Modelling of $SiO_2$ Chemical–Mechanical Polishing Planarization", Peter A. Burke, IBM General Technology Division, Vermont, 6 pp., believed published prior to Aug. 8, 1994.

"Chemical Mechanical Planarization of Multilayer Dielectric Stacks", Manoj D. Jain, etc., Texas Instruments, SPIE vol. 2335, pp. 2–11, believed published prior to Aug. 8, 1994.

"Measurement and Modelling of Pattern Sensitivity During Chemical Mechanical Polishing of Interlevel Dielectrics", S. Sivaram, etc., Sematech, Inc., Texas, pp. 511–517, believed published 1992.

"Stylus Profiler Monitors Chemical Mechanical Planarization Performance", John Reilly, 1994 IEEE/SEMI Advanced Semiconductor Manufacturing Conference, pp. 320–324.

"Application of Run by Run Controller to the Chemical–Mechanical Planarization Process", Part II, Albert Hu, etc., 1994 IEEE/CPMT Int'l Electrics Manufacturing Technology Symposium, pp. 371–378.

Beppu et al., "Using CMP for Planarization Polishing of Interlayer Dielectric Film", Semiconductor World, pp. 58–62, Jan. 1994.

Watanabe et al., "Characteristics and Trends of CMP Equipment", Denshi Zairyo, pp. 91–96, Mar. 1994.

Kurobe and Imanaka, "Novel Surface Finishing Technique Controlled by Magnetic/Electric Field", Proceedings of the 5th International Conference on Production Engineering Tokyo, pp. 259–264, 1984.

Mutter, "Choice Stop Material for Chemical/Mechanical Polish Planarization", IBM Technical Disclosure Bulletin, vol. 27, No. 8, p. 4642, Jan. 1985.

Beyer et al., "Glass Planarization by Stop–Layer Polishing", IBM Technical Disclosure Bulletin, vol. 27, No. 8, pp. 4709–4710, Jan. 1985.

Garroux and Zunino, "Reducing the Wafer Deformation Induced by Polishing", IBM Technical Disclosure Bulletin, vol. 28, No. 4, pp. 1635–1636, Sep. 1985.

Ashley et al., "Planarization of Metal Substrates for Solar Mirrors", Mat. Res. Soc. Symp. Proc., vol. 121, pp. 635–638, 1988.

Daubenspeck et al., "Planarization of ULSI Topography Over Variable Pattern Densities", IBM General Technology Division, 2 pages, Dec. 1988.

Suzuki et al., "Study on Magnetic Field–Assisted Polishing —Application to a Spherical Surface", JSPE, pp. 1053–1058, 1989.

Suzuki et al., "Magnetic Field–Assisted Polishing —Application to a Curved Surface", Precision Engineering, vol. 11, No. 4, pp. 197–202, Oct. 1989.

Patrick et al., "Application of Chemical Mechanical Polishing to the Fabrication of VLSI Circuit Interconnections", J. Electrochem. Soc., vol. 138, No. 6, pp. 1778–1784, Jun. 1991.
Kaanta et al., "Dual Damascene: A ULSI Wiring Technology", IEEE VMIC Conference, pp. 144–152, Jun. 11–12, 1991.
Homma et al., "Fully Planarized Multilevel Interconnection Using Selective $SiO_2$ Deposition", NEC Res. & Develop., vol. 32, No. 3, pp. 315–322, Jul. 1991.
Warnack, "A Two–Dimensional Process Model for Chemimechanical Polish Planarization", J. Electrochem. Soc., vol. 138, No. 8, pp. 2398–2402, Aug. 1991.
Hayashi et al., "A New Abrasive–Free, Chemical–Mechanical–Polishing Technique for Aluminum Metallization of ULSI Devices", IEEE IEDM, pp. 976–978, 1992.
Landis et al., "Integration of Chemical–Mechanical Polishing into CMOS Integrated Circuit Manufacturing", Thin Solid Films, vol. 220, pp. 1–7, 1992.
Singer, "Searching for Perfect Planarity", Semiconductor International, pp. 44–48, Mar. 1992.
Yu et al., "Dishing Effects in a Chemical Mechanical Polishing Planarization Process for Advanced Trench Isolation", Appl. Phys. Lett., vol. 61, No. 11, pp. 1344–1346, Sep. 14, 1992.
Morimoto et al., "Characterization of Chemical–Mechanical Polishing of Inter–Metal Dielectric Film", Proceedings of the Symposia on Interconnnects, Contact Metallization, and Multilevel Metallization and Reliability for Semiconductor Devices, Interconnects, and Thin Insulator Materials, pp. 122–130, 1993.
Runnels, "Modeling the Effect of Polish Pad Deformation on Wafer Surface Stress Distributions During Chemical–Mechanical Polishing", Proceedings of the Symposia on Interconnects, Contact Metallization, and Multilevel Metallization and Reliability for Semiconductor Devices, Interconnects, and Thin Insulator Materials, pp. 110–121, 1993.
Yu et al., "A Statistical Polishing Pad Model For Chemical–Mechanical Polishing", IEEE IEDM, pp. 865–868, 1993.
Cook and Marty, "Planarization by Polishing: New Uses for an Old Technology", 14 pages, Feb. 24, 1993.
Iscoff, "CMP Takes a Global View", Semiconductor International, pp. 72–74, 76, and 78, May 1993.
"CMP Application to Manufacturing Has Started, It Covers ASI and DRAM", Nikkei Microdevices, pp. 50–55, 1994.
English translation of "CMP Application to Manufacturing Has Started, It Covers ASI and DRAM", Nikkei Microdevices, pp. 50–55, 1994. (translation 12 pages).
Yu et al., "Combined Asperity Contact and Fluid Flow Model for Chemical–Mechanical Polishing", IEEE NUPAD V, pp .29–32, 1994.
Bajaj et al., "Effect of Polishing Pad Material Properties on Chemical Mechanical Polishing (CMP) Processes", Mat. Res. Soc. Symp. Proc., vol. 337, pp. 637–644, 1994.
Howland et al., "Metrology and Inspection Techniques for CMP Applications", Semicon West, pp. 1–27, 1994.
Stell et al., "Planarization Ability of Chemical Mechanical Planarization (CMP) Processes", Mat. Res. Soc. Symp. Proc., vol. 337, pp. 151–156, 1994.
Martinez, "Chemical–mechanical Polishing: Route to Global Planarization", Solid State Technology, pp. 26–27, May 1994.
Sivaram, "Planarazition Development", VLSI Multilevel Interconnection State–of–the–Art Seminar Visuals Booklet, pp. 305–345, Jun. 9, 1994.
Jairath et al., "Chemical–mechanical Polishing: Process Manufacturability", Solid State Technology, pp. 71–75, Jul. 1994.
Karaki–Doy et al., "Global Planarization Technique by High —Precision Polishing and Its Characteristics", pp. 174–180, Undated.
Yuan et al., "A Novel Wafer Carrier Ring Design Minimizes Edge Over–Polishing Effects for Chemical Mechanical Polishing", 3 pages, Undated (post–1994).
Marty, "Polishing Materials and Their Relation to the CMP Process", pp. 1–10, Undated (Post–1992).
Ketchen et al., "Sub–μm, Planarized, Nb–$AlO_x$–Nb Josephson Process for 125 mm Wafers Developed in Partnership with Si Technology", 3 pages, Undated, (post–1991).
Beyer and Pliskin, "Borosilicate Glass Trench Fill", IBM Technical Disclosure Bulletin, vol. 27, No. 2, pp. 1245–1247, Jul. 1984.
Kaanta et al., "Submicron Wiring Technology with Tungsten and Planarization", Proceeding of IEDM, pp. 1–8, Dec. 1987.
Ives and Leung, "Noncontact Laminar–flow Polishing for GaAs", Rev. Sci. Instrum., vol. 59, No. 1, pp. 172–175, Jan. 1988.
Zingg et al., "Thinning Techniques for 1 μm ELO–SOI", 1988, SOS/SOI Technology Workshop Proceedings, p. 52, Oct. 3–5, 1988.
Cote et al., "Mechanical Polish Clean Up After M2 CVD W Blanket Etch for CMOS DRAM", IBM Technical Disclosure Bulletin, vol. 31, No. 12, pp. 189–190, May 1989.
"Method for Elimination of Scratches in Polished Damascene Conductors", Research Disclosure, No. 322, 1 page, Feb. 1991.
Uttecht and Geffken, "A Four–Level–Metal Fully Planarized Interconnect Technology for Dense High Performance Logic and SRAM Applications", IEEE VMIC Confercence, pp. 20–26, Jun. 11–12, 1991.
Kaufman et al., "Chemical–Mechanical Polishing for Fabricating Patterned W Metal Features as Chip Interconnects", J. Electrochem. Soc., vol. 138, No. 11, pp. 3460–3465, Nov. 1991.
Kolenkow et al., "Chemical–Mechanical Wafer Polishing and Planarization in Batch Systems", Solid State Technology, pp. 112–114, Jun. 1992.
Roehl et al., "High Density Damascene Wiring and Borderless Contacts for 64 M DRAM", IEEE VMIC Conference, pp. 22–28, Jun. 9–10, 1992.
Joshi, "A New Damascene Structure for Submicrometer Interconnect Wiring", IEEE Electron Device Letters, vol. 14, No. 3, pp. 129–132, Mar. 1993.
Keast et al., "Silicon Contact Formation and Photoresist Planarization Using Chemical Mechanical Polishing", IEEE VMIC Conference, pp. 204–205, Jun. 7–8, 1994.
Search Report Results, "Chemical Mechanical Polishing —Patents", pp. 1–44, Dec. 20, 1995.
Search Report Results, "Chemical Mechanical Polishing —Technical", pp. 1–53, Dec. 20, 1995.
Gonnella and Shen, "Fine Polishing Abrasive Wheel Using Flexible High–Density Urethane Foams", IBM Technical Disclosure Bulletin, vol. 25, No. 3B, pp. 1604–1605, Aug. 1982.
LaRose and Sherk, "Abrasive for the Production of Anti–Glare Surfaces on Displays", IBM Technical Disclosure Bulletin, vol. 25, No. 11A, p. 5804, Apr. 1983.
Biver et al. "Method of Microroughening the $Al_2O_3$ TiC Substrates of Magnetic Sliders", IBM Technical Disclosure Bulletin, vol. 26, No. 7A, Dec. 1983.

Koshiyama, "Lapping and Polishing Wafers for Modern Monolithic Microcircuits", Microelectronic Manufacturing and Testing, pp. 19–20, Oct. 1988.
Sadagopan, "Garnet Substrate Surface Preparation ", IBM Technical Disclosure Bulletin, vol. 15, No. 11, p. 3527, Apr. 1973.
McLaughlin, "Cutting with Wires and Polishing with Diamonds", SME's Westec, pp. 158–167, Mar. 1979.
Brandmyer and Vig, "Chemical Polishing in Etching Solutions That Contain Surfactants", 39th Annual Frequency Control Symposium, pp. 276–281, 1985.
Oliker et al., "Machining of Plastics with Magnetoabrasive Powders", translated from Poroshkovaya Metallurgiya, No. 5, (269), pp. 70–74, May 1985.
Bhushan and Martin, "Accelerated Wear Test Using Magnetic–Particle Slurries", STLE Tribology Transactions, vol. 31, No. 2, pp. 228–238, May 1985.
Maiboroda and Shyluko, "Motion of a Ferromagnetic Powder During Magnetoabrasive Polishing", translated from Poroshkovaya Metallurgiya, No. 8(296), pp. 3–8, Aug. 1987.
Stowers et al., "Review of Precision Surface Generating Processes and their Potential Application to the Fabrication of Large Optical Components", SPIE, vol. 966, Advances in Fabrication and Metrology for Optics and Large Optics, pp. 62–73, 1988.
Kuneida et al., "Robot–Polishing of Curved Surface with Magnetically Pressed Polishing Tool", JSPE, pp. 125–131, 1988.
Fielder, "Lixiviation Effects in Glass Polishing", SPIE, vol. 1128, Glasses for Optoelectronics, pp. 45–47, 1989.
Natishan et al., "Surface Preparation of Aluminam for Ion Implantation", Metallography, vol. 23, pp. 21–26, 1989.
Brown and Fuchs, "Shear Mode Grinding", Proceedings of the 43rd Annual Symposium on Frequency Control —1989, pp. 606–610, May 31–Jun. 2, 1989.
Shinmura, "Development of a Unit System Magnetic Abrasive Finishing Apparatus using Permanent Magnets", Bull. Japan Soc. of Prec. Engg., vol. 23, No. 4, pp. 313–315, Dec. 1989.
"Ceraic Planarizing Layer", Research Disclosure, No. 319, 1 page, Nov. 1990.
Cook, "Chemical Processes in Glass Polishing", Journal of Non–Crystalline Solids, vol. 120, pp. 152–171, 1990.
Iler, *The Chemistry of Silica,* pp. 3–5, 48–49, 58–65, 370–379, 666–669, 672–679, and 720–725, Undated.
Ruben, "Magnetabrasive Finishing: A Method for the Machining of Complicated Shaped Workpieces" pp. 239–256, Undated.
Namba, "Mechanism of Float Polishing", pp. TuB–A2–1 to TuB–A2–4, Undated.
Kumagai et al., "Mechano–Chemical Polishing of Titanium", pp. 2555–2564, Undated.
Malcolme–Lawes et al. "A Capacitance Method for Monitoring the Rate of Polishing of Self–Polishing Polymers in the Laboratory", Polymer Testing, vol. 9, pp. 91–101, 1990.
Aoki et al., "Novel Electrolysis–Ionized–Water Cleaning Technique for the Chemical–Mechanical Polishing (CMP) Process", 1994 Symposium on VLSI Technology Digest of Technical Papers, pp. 79–80, 1994.
Yu et al., "Improved Multilevel Metallization Technology Using Chemical Mechanical Polishing of W Plugs and Interconnects", Proceedings of the 11th International VLSI Multilevel Interconnection Conference (VMIC), pp. 144–150, Jun. 7–8, 1994.
Ali et al., "Investigating the Effect of Secondary Palten Pressure on Post–Chemical–Mechanical Planarization Cleaning", Microcontamination, pp. 45–50, Oct. 1994.
Roy et al., "Postchemical–Mechanical Planarization Cleanup Process for Interlayer Dielectric Films", J. Electrochem. Soc., vol. 142, No. 1, pp. 216–226, Jan. 1995.
Krussell et al., "Mechanical Brush Scrubbing for post–CMP clean", Solid State Technology, pp. 109–114, Jun. 1995.
Search Results, "Wafer Cleaning —Patents", pp. 1–83, Dec. 20, 1995.
Search Results, "Wafer Cleaning —Technical", pp. 1–29, Dec. 20, 1995.
*Magnetic Fluids Bibliography,* pp. 313 and 378, Undated. Search Results, 4 pages, Undated.
Ferrofluidics Corporation, *Ferrofluids: Physical Properties and Applications,* pp. 1–10, 1986.
Nakatsuka, "Magnetic Fluids and Their Applications", JSPE, pp. 51–55, 1989.
English translation of Nakatsuka, "Magnetic Fluids and Their Applications", from JSPE, pp. 51–55, 1989. (translation pp. 1–12).
Anton et al., "Application Orientated Researchers on Magnetic Fluids", Journal of Magnetism and Magnetic Materials, vol. 85, pp. 219–226, 1990.
Fujita et al., "Basic Study of Heat Convention Pipe Using the Developed Temperature Sensitive Magnetic Fluid", Journal of Magnetism and Magnetic Materials, vol. 85, pp. 203–206, 1990.
Raj and Moskowitz, "Commercial Applications of Ferrofluids", Journal of Magnetism and Magnetic Materials, vol. 85, pp. 233–245, 1990.
Zubko et al., "Electrical Properties of Magnetic Fluids", Journal of Magnetism and Magnetic Materials, vol. 85, pp. 151–153, 1990.
Zahn, "Ferrohydrodynamic Torque–Driven Flows", Journal of Magnetism and Magnetic Materials, vol. 85, pp. 181–186, 1990.
Blums et al., "Introduction to the Magnetic Fluids Bibliography", Journal of Magnetism and Magnetic Materials, vol. 85, pp. 303–304, 1990.
Bacri et al, "Ionic Ferrofluids: A Crossing of Chemistry and Physics", Journal of Magnetism and Magentic Materials, vol. 85, pp. 27–32, 1990.
Rosenweig et al., "Magnetic Fluid Motion in Rotating Field", Journal of Magnetism and Magnetic Materials, vol. 85, pp. 171–180, 1990.
Boudouvis and Scriven, "Multifurcation of Patterns in Ferrofluids", Journal of Magnetism and Magnetic Materials, vol .85, pp. 155–158, 1990.
Kamiyama and Satoh, "Pipe–Flow Problems and Aggregation Phenomena of Magnetic Fluids", Journal of Magnetism and Magnetic Materials, vol. 85, pp. 121–124, 1990.
Kikura et al, "Propagation of Surface of Magnetic Fluids in Traveling Magnetic Fields", Journal of Magnetism and Magnetic Materials, vol. 85, pp. 167–170, 1990.
Bologa et al., "Some Effects in Coarse Suspension Ferromagnetic Systems Under Alternating Magentic Field Influence", Journal of Magnetism and Magnetic Materials, vol. 85, pp. 187–189, 1990.

FIG. 3B
(Prior Art)
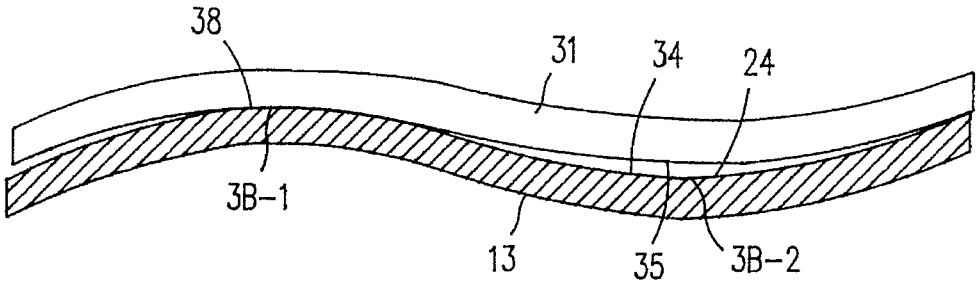
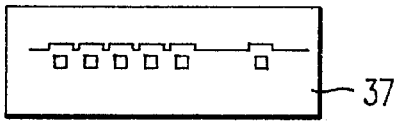
FIG. 3B-1
(Prior Art)
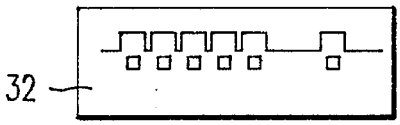
FIG. 3B-2
(Prior Art)
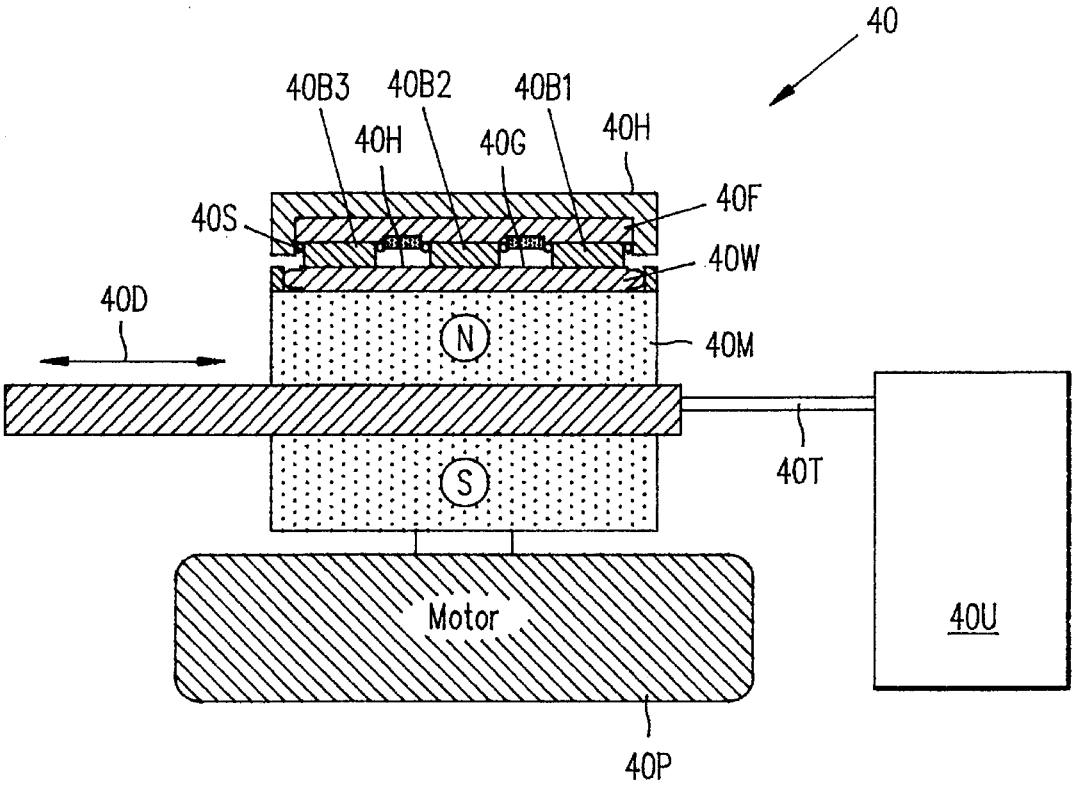
FIG. 4

METHOD AND STRUCTURE FOR POLISHING A WAFER DURING MANUFACTURE OF INTEGRATED CIRCUITS

FIELD OF INVENTION

This invention generally relates to a method and structure for smoothing irregular surfaces, and in particular to a method and structure for smoothing the irregular surface of a semiconductor wafer during manufacture of an integrated circuit.

BACKGROUND OF THE INVENTION

Traditionally, integrated circuits are built upon a flat disk shaped crystal silicon substrate, hereinafter referred to as a blank silicon wafer. The surface of a blank silicon wafer is subdivided into a plurality of rectangular areas on which are formed photolithographic images, such as photolithographic images 15A, 15B, 15C, 15D, 15E, 15F, 15G, 15H, 15I, 15J, 15K, 15L, 15M, 15N and 15P on wafer 13 of FIG. 1. Not all of the photolithographic images in FIG. 1 are numbered for clarity. Commonly, each of the photolithographic images is identical to another photolithographic image on a given wafer, such as wafer 13. Through a series of integrated circuit processing steps, each of the rectangular areas of wafer 13 eventually becomes an individual integrated circuit die.

FIG. 2A illustrates an enlargement of photolithographic image 15A, illustrating a dense electrical wiring area 25 and a small structure wiring area 29 included in photolithographic image 15A. A dense electrical wiring area is any area of a photolithographic image which has a higher density of electrical wiring than other areas and can include, for example, a static random access memory (SRAM) or other random access memory circuit. A small structure wiring area is any of a photolithographic image which has a small quantity of electrical wiring and which is surrounded by an area sparse of electrical wiring, and can include, for example, a single electrical connection line as might be possible in logic circuitry. As each photolithographic image is typically identical to another photolithographic image, the dense electrical wiring area 25 and the small structure wiring area 29 in each of the photolithographic images form a repeating pattern on wafer 13.

Until recently, use of precision polish machines in semiconductor integrated circuit manufacture was restricted to the final preparation of blank silicon wafers, after which the blank silicon wafers were used as substrates for manufacturing the integrated circuits, without any further polishing. Recently, precision polishing has found new uses, subsequent to the final preparation of the blank silicon wafer, during the manufacture of integrated circuits. For instance, U.S. Pat. No. 4,910,155, entitled "Wafer Flood Polishing" granted to Cote et al. issued Mar. 20, 1990, describes a method of polishing wafers during integrated circuit manufacture using polishing pads adapted from pads used in the final preparation of blank silicon wafers, prior to construction of integrated circuits. The pads used in the final preparation were originally designed to polish both sides of a blank silicon wafer (double sided polishing) to a flatness and to a parallelism specification. The new polishing processes used during the manufacture of integrated circuits require only one side of a wafer to be polished, without reference to the other side of the wafer (single sided polishing).

Many of the new polishing processes remove unwanted protrusions formed on the surface of the wafer during some processes associated with integrated circuit manufacture. For example, aluminum wires, formed in a photolithographic image to interconnect transistor junctions, are subsequently coated with an insulation layer, such as silicon dioxide resulting in the unwanted protrusions. The formation of unwanted protrusions is illustrated in a representative cross-section of two portions of a typical integrated circuit die 15A shown in FIG. 2B. Substrate 21, has electrically conductive lines 25A, 25B, 25C, 25D, 25E, 25F, 25G (collectively referred to by reference numeral 25) and 29, typically made of an aluminum alloy. Electrically conductive lines 25 and 29 are then coated with a glass or other insulating layer 20.

As insulating layer 20 is deposited, insulating layer 20 conforms to the existing surface, including lines 25 and 29 to form corresponding protrusions 27A, 27B, 27C, 27D, 27E, 27F, 27G (collectively referred to by reference numeral 27) and 23. Therefore protrusions 27 and 23 are shapes replicated on a wafer surface 24 by insulating layer 20, from the topography below insulating layer 20. Each of the protrusions, such as protrusions 27A, 27B, 27C and 23 has a top surface, such as top surfaces 27AT, 27BT, 27CT, 27GT and 23T which are parallel to wafer surface 24. Not all top surfaces are numbered for clarity. In a typical 0.7 micron CMOS process, before polish, insulation layer 20 has a thickness t1=t2=20,000 Å and protrusions 27 and 23 have a height t4 equal to t3, the thickness of electrically conductive lines 25 and 29, which is about 10,000 Å. The distance t5 between the wafer surface 24 and electrically conductive line 29 after polishing is, ideally about 10,000 Å±100 Å and changes according to the density and width of protrusions 27 and 23 and also depends on the polishing process parameters such as the size and hardness of a polishing pad.

In present day integrated circuit technology, as more than one electrically conductive layer is required to carry electrical signals to the underlying transistor junctions of the integrated circuits, protrusions 27 and 23 in insulating layer 20 must be smoothed, or planarized i.e. removed so that wafer surface 24 is a planar surface over all of insulating layer 20. Therefore, using conventional planarization techniques, in one case, one of electrically conductive lines 25 is separated from wafer surface 24 by a distance t5 of about 10,000 Å while the electrically conductive line 29 is separated from wafer surface 24 by a distance t5 of about 7000 Å after polishing in the 0.7 micron CMOS process (above). This variation in distance t5 across the same photolithographic image is due to bending of the polishing pad is called the local polishing removal uniformity. Applicant believes that polishing of photolithographic image 15A by a die sized block also results in a similar variation in local polishing removal uniformity, due to tilting or instability of the block.

To remove protrusions 27 and 23, protrusions 27 and 23 are rubbed against a polishing pad 31 (FIG. 3A) by a sideways motion represented by arrow 33. Polishing pad 31 rests on top surfaces of protrusions 27 and 23. Protrusions 27 are formed over dense wiring area 25 and protrusion 23 is formed over small structure wiring area 29. Protrusion 23 is a single protrusion because small structure wiring area 29 is a single electrical connection line located in a less dense wiring area of the integrated circuit. As protrusion 23 is relatively isolated from other protrusions, top surface 23T of protrusion 23 provides less support for polishing pad 31 than the support collectively provided by the top surfaces of protrusions 27.

In some cases the polishing pad eroding surface 35 is partially constructed with an impregnated abrasive while in other cases a liquid slurry is used to deposit small abrasive particles between eroding surface 35 of polishing pad 31 and the surface of the wafer. As polishing starts, eroding surface 35 contacts and is forced against the top surfaces of protrusions 27 and 23. Moreover, depending on the bulk hardness of eroding surface 35, eroding surface 35 bends or distends into the area sparse of electrical wiring, between protrusions 27 and protrusion 23. Therefore insulating layer 20 over the area of sparse electrical wiring or over a large open space without wiring such as the area around point 30 is also polished as protrusions 27 and 23 are polished.

Also, protrusion 23 is polished at a much faster rate than protrusions 27, because within the area covered by protrusions 27, the average raised area that polishing pad 31 rests on is greater, and thus less actual pressure per unit area is applied during polishing on the top surfaces of protrusions 27 as compared to protrusion 23. Therefore the region of photolithographic image 15A (FIG. 1A) covered by protrusions 27 has the slowest rate of material removal in photolithographic image 15A. Faster removal of insulation layer 20 over a small structure wiring area causes insulation layer 20 below protrusion 23 to thin significantly after protrusion 23 has been sufficiently planarized while the more dense structure of protrusion 27 takes longer to be planarized. In actual practice, the total topography will not be reduced if soft polishing pads are used. Only smoothing of the surface protrusions will occur.

Hard polishing pads do not bend as much as soft polishing pads. Therefore as photolithographic image 5A is planarized, a hard polishing pad does not polish protrusion 23 over small structure wiring area 29 at as much of an accelerated rate as a softer polishing pad. The effect of higher polishing rate of one or more protrusions over a small structure wiring area than the polishing rate of protrusions over a dense electrical wiring area results in nonuniform thickness removal and hence nonuniformity of the remaining insulation layer across a photolithographic image, which was described above as local polishing removal uniformity.

FIG. 3B is a cross-sectional view of wafer 13 along the direction 3B—3B of FIG. 1. The protrusions of wafer 13 (FIG. 1) are not visible on wafer 13 (FIG. 3B) and are shown in FIG. 3B as the enlarged insets 37 and 32. In FIG. 3B, polishing pad 31 is typically larger than wafer 13 and touches wafer surface 24 with more pressure at the beginning of polishing in the portion 38 than in the portion 34 because wafer 13 has a curvature. The curvature can be in the form of a potato chip which in cross-section appears as an "S" shaped bow to wafer surface 24 (FIG. 3B), representative of the warpage often found across silicon wafers that have undergone high temperature processing and deposition of many stacked thin film layers on the frontside and backside of wafer 13. Additionally variations in actual wafer thickness causes variations in polishing rate across a wafer.

Curvature of polishing pad 31 deviates from the curvature of wafer 13, depending on the hardness of eroding surface 35. Therefore, polishing pad 31 does not exert a uniform force on wafer 13, unless polishing pad 31 is soft enough to completely conform to wafer surface 24 of a warped wafer 13. In FIG. 3B, the height of protrusions on wafer surface 24 in portion 38 (cross-section 37) is smaller than the height of the protrusions on wafer surface 24 in portion 34 (cross-section 32) because of difference in polishing pressure. The polishing pressure difference across the whole eroding surface of a polishing pad leads to nonuniform removal and hence nonuniform thickness of the remaining insulation layer, because polishing has to continue after the protrusions are removed in portion 38 until all protrusions are removed in portion 34. Such nonuniformity of the insulation layer remaining after polishing across a large part of a wafer is hereinafter referred to as global polishing removal uniformity.

Workers in the art of polishing semiconductor wafers for the purpose of integrated circuit planarization have found that a soft polishing pad achieves good global polishing removal uniformity but poor local polishing uniformity. In contrast, a hard polishing pad achieves good local polishing removal uniformity but poor global polishing removal uniformity.

To achieve both good local polishing removal uniformity and good global polishing removal uniformity during the same polishing process, many workers in the field have experimented with layered polishing pads. U.S. Pat. No. 5,257,478 entitled "Apparatus for Interlayer Planarization of Semiconductor Material" by Hyde and Roberts issued Nov. 2, 1993 describes a pad of "at least two layers" where one layer is harder or less flexible than the other layer. U.S. Pat. No. 5,197,999 entitled "Polishing Pad for Planarization" by Thomas issued Mar. 30, 1993 describes a stiffening agent included in the polishing pad to improve planarization of an integrated circuit. However, significant global polishing removal uniformity is sacrificed when the polishing pad is stiffened to improve local polishing removal uniformity, because a hard pad does not conform to the curvature of a wafer.

To improve local polishing removal uniformity without a significant sacrifice in global polishing removal uniformity, many new polishing pad designs have been recently disclosed. For example, FIG. 3 of "A New Pad and Equipment Development for ILD Planarization" by Beppu et al., Semiconductor World, January 1994 shows use of small polishing blocks suspended on a resilient backing whereby the blocks slide independently across the wafer. Although Beppu et al. fail to explicitly state any dimensions for the blocks, the blocks appear to be twice the size of a protrusion, and hence less than the size of a die. Blocks of such a small size result in loss of local polishing removal uniformity because polish rate is a function of protrusion density.

U.S. Pat. No. 5,212,910 entitled "Composite Polishing Pad for Semiconductor Process" by Breivogel et al. issued May 25, 1993 describes use of a soft backing film behind a hard outer polishing layer. The inner soft layer is divided into tiles (Col. 4, lines 52–68) to give the outer layer more independent resiliency. The lateral dimension of the tiles is optimally selected to correspond approximately to the width of an individual die on the silicon wafer (Col. 5, lines 49–51). However, a die sized tile fails to protect a small structure wiring area from higher polishing rate, because the tile must rest on a corner of a dense electrical wiring area, and on the small structure wiring as shown in FIG. 2A, As polishing progresses, the polishing pad will polish the protrusions over the small structure wiring area faster, causing the tile to tilt.

Such a tilt causes slower polishing of the dense electrical wiring area and faster polishing of the small structure wiring area. Tilt of a block or tile can also cause surface fracturing of the insulating glass and thus failure of the insulation layer. Tilt of a block or tile also results in rounding at the edge of a dense electrical wiring area such as a SRAM.

U.S. Pat. No. 5,230,184 entitled "Distributed Polishing Head" by Bukhman issued Jul. 27, 1993 discloses polishing pads larger than a scribe grid and "usually sized on an order of the individual VLSI die" (Col. 2, lines 64–66). One problem with the apparatus of Bukhman is that when one of the blocks is lifted by a protrusion, the membrane supporting the blocks must lift adjacent blocks by a given amount, and therefore tilt the adjacent blocks, and so reduce the polish rate and removal uniformity of the adjacent blocks. Moreover, a block will tilt as the block leaves a dense electrical wiring area, because the block has the size of a single integrated circuit die. Problems due to tilt of a block have been described above, in reference to Breivogel et al.

SUMMARY OF INVENTION

A polishing apparatus in accordance with this invention has a plurality of blocks such that each block is supported entirely independent of an adjacent block, so that lifting motion of one block is not transferred to adjacent blocks. The polishing apparatus uses reciprocable mounting of the blocks in slots to ensure independent flexibility as the blocks are forced to follow the curvature of a wafer during polishing, thus accomplishing good global polishing removal uniformity. The polishing apparatus uses small blocks with an eroding surface of a very hard design to ensure minimal deflection into the microstructure of an integrated circuit thus accomplishing good local polishing removal uniformity. Such a polishing apparatus has an increased lifetime, much greater than the lifetime of conventional polishing apparatuses, as the entire block can be made of the selected polishing material.

In one embodiment, the polishing apparatus includes a fluid for applying pressure to each of the blocks which in turn force an eroding surface against the wafer surface. In one specific embodiment, the fluid is a magnetic fluid and the polishing apparatus has a magnet which applies magnetic force on the fluid that is in turn, transferred to the blocks.

The blocks are arranged around a circle and alternatively around two concentric circles in two embodiments of the invention. The polishing apparatus rotates the blocks around the circle on which the blocks are arranged. The polishing apparatus also includes a wafer support arm to hold the wafer while the wafer is being polished. The wafer support arm translates the wafer at a constant uniform speed along a radial line of the circle or circles of the blocks in a plane perpendicular to an axis of rotation of the blocks, until all parts of the wafer have crossed the circular path of the blocks.

In accordance with this invention, to avoid loss of local polishing removal uniformity, each block must have an eroding surface no smaller than the eroding surface necessary for a block to be always supported by at least three regions, each of the regions including at least one protrusion, each of the regions having the slowest rate of material removal within a photolithographic image which includes that region. As each block has a triangle of support formed by the three regions, the block's eroding surface can be made very hard to reduce bending of the eroding surface and so, protect the faster eroding features of the photolithographic image.

To ensure a triangle of support at all times during relative motion, a dimension of an eroding surface must be greater than twice the largest side of a triangle, wherein the triangle is the largest possible triangle having a region of slowest material removal at each corner such that the triangle excludes all other slowest material removal regions on the wafer. The dimension ensures that as the block leaves one triangle of support during relative movement, another triangle support is formed, thus ensuring at least one triangle of support at all times. The block can have any shape so that the dimension of the eroding surface referred to above can be, for example, the diameter of a circle, the side of a square, the smaller side of a rectangle and the smaller side of an ellipse.

In accordance with this invention, to avoid loss of global polishing e.g. removal uniformity, the maximum area for an eroding surface of the block is the largest possible area for the eroding surface such that the eroding surface remains in contact with every protrusion of the wafer that is covered by the eroding surface, prior to any relative motion between the block and the wafer. Therefore the eroding surface of the block has the largest area possible for the eroding surface to have a curvature which deviates from a curvature of the wafer by a predetermined amount, and depends on the modulus of elasticity of the eroding surface.

A block substantially improves local polishing removal uniformity without sacrificing global polishing removal uniformity, when the smallest dimension of the eroding surface is approximately three times the size of a side of a photolithographic image.

BRIEF DESCRIPTION OF THE DRAWINGS

FIG. 3B is a cross sectional view of the wafer of FIG. 1 along the direction 3B—3B.

FIG. 4 illustrates a polishing apparatus in accordance with this invention.

DETAILED DESCRIPTION

In accordance with this invention, a block for removing a film of a wafer uses the repeating nature of the photolithographic images on the wafer's surface to form a triangle of support for a block at all times during relative motion between the wafer and the block, thereby allowing a substantial improvement in local and global polishing removal uniformity.

FIG. 4 illustrates a cross-sectional view of a polishing apparatus in accordance with this invention. In this embodiment, polishing apparatus 40 has a magnetic fluid 40F enclosed in housing 40H. Housing 40H is held stationary by a bracket (not shown). Magnetic fluid 40F is attracted by magnet 40M so as to apply a force on blocks 40B1, 40B2, 40B3 and other blocks not shown. In the embodiment shown in FIG. 4, magnetic fluid 40F is sealed by seals 40S around the blocks of polishing apparatus 40. The downwards force applied by magnetic fluid 40F is transferred by blocks 40B1, 40B2 and 40B3 to wafer 40W. Hence the field from magnet 40M attracts magnetic fluid 40F, which in turn causes blocks 40B1, 40B2 and 40B3 to come into contact with wafer 40W.

In the embodiment of FIG. 4, the blocks are the size of three die on the surface of wafer 40W, for best local and global uniformity. A horizontal ultrasonic motion shown by arrow 40D is imparted to magnet 40M by ultrasonic motion generator 40U causing polishing in the uncovered areas 40G, 40H. The distance of travel shown by arrow 40D must be sufficient to cause uniform removal across the surface of the wafer. The design of FIG. 4 can be modified by using motor 40P to average the removal uniformity gradient across the surface of the wafer.

In accordance with this invention, a block, such as block 40B2 is pushed onto a wafer independent of the adjacent blocks, such as blocks 40B1 and 40B3, unlike the prior art. The block sliding across the curvature of the surface of the wafer does not affect adjacent blocks and hence ensures good global polishing removal uniformity. As the blocks are small and do not need to conform to the global curvature of the wafer, the blocks can be made of a very hard polishing material, such as urethane, unlike prior art polishing pads made of softer material to allow the pad to conform to the wafer's curvature. Also, because the blocks are much smaller than a prior art polishing pad, the hydroplaning effect found in using the prior art polishing pad is absent in a polishing apparatus in accordance with this invention, thereby allowing the blocks to be moved faster across a wafer, achieving faster polish removal rates.

Figure 1:
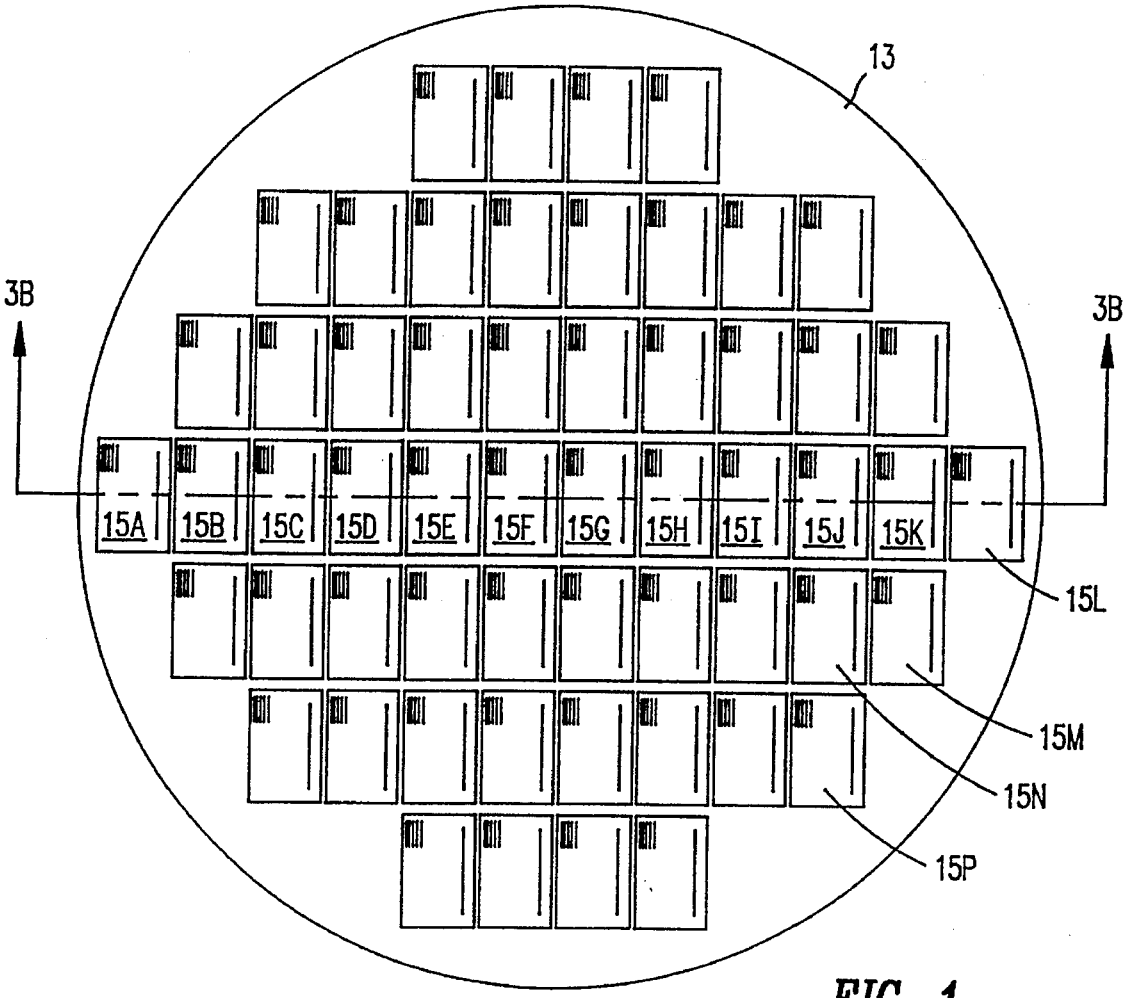
FIG. 1 (Prior Art)
FIG. 1 illustrates a wafer of the prior art having a number of rectangular areas on which are formed photolithographic images during the manufacture of integrated circuits.
Figure 2A:
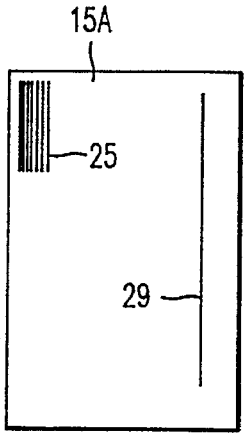
FIG. 2A (Prior Art)
FIG. 2A illustrates an enlargement of a photolithographic image shown in FIG. 1.
Figure 2B:
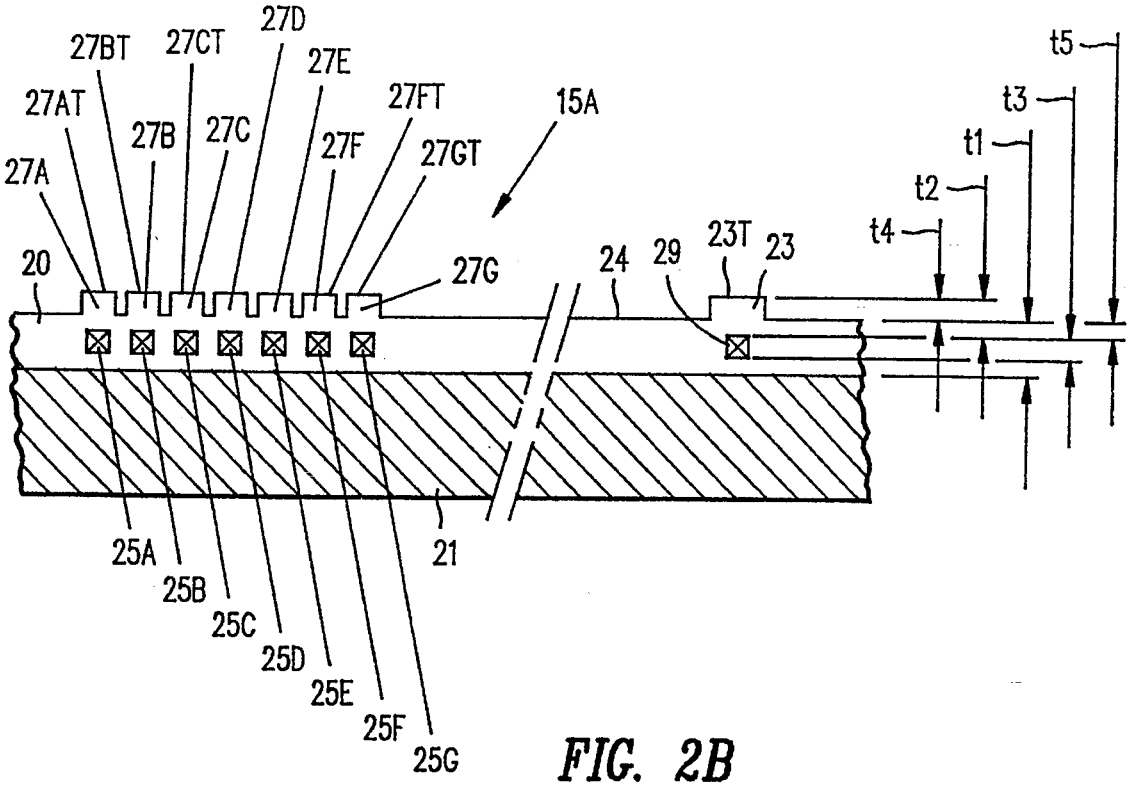
FIG. 2B (Prior Art)
FIG. 2B is a representative cross section of a typical photolithographic region shown in FIG. 2A.
Figure 3A:
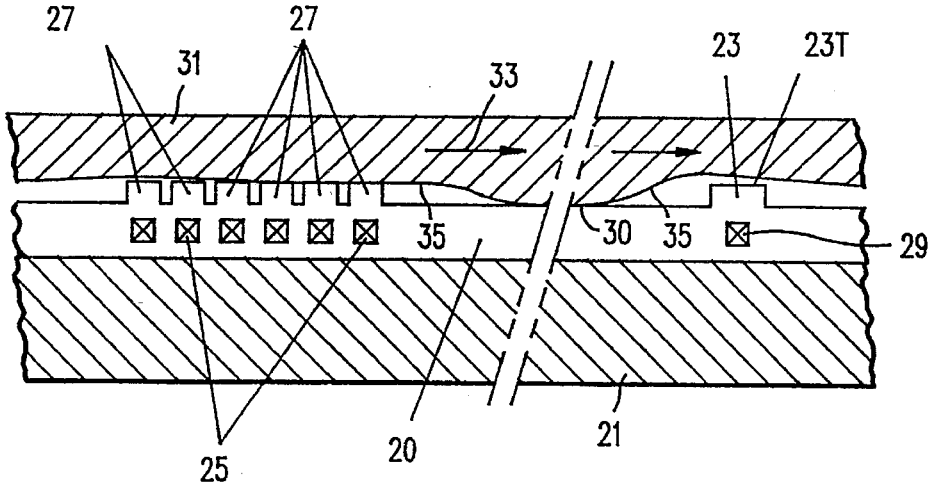
FIG. 3A (Prior Art)
FIG. 3A illustrates the use of a prior art polishing pad to remove protrusions formed during manufacture of integrated circuits on the wafer of FIG. 1.
Figure 5A:
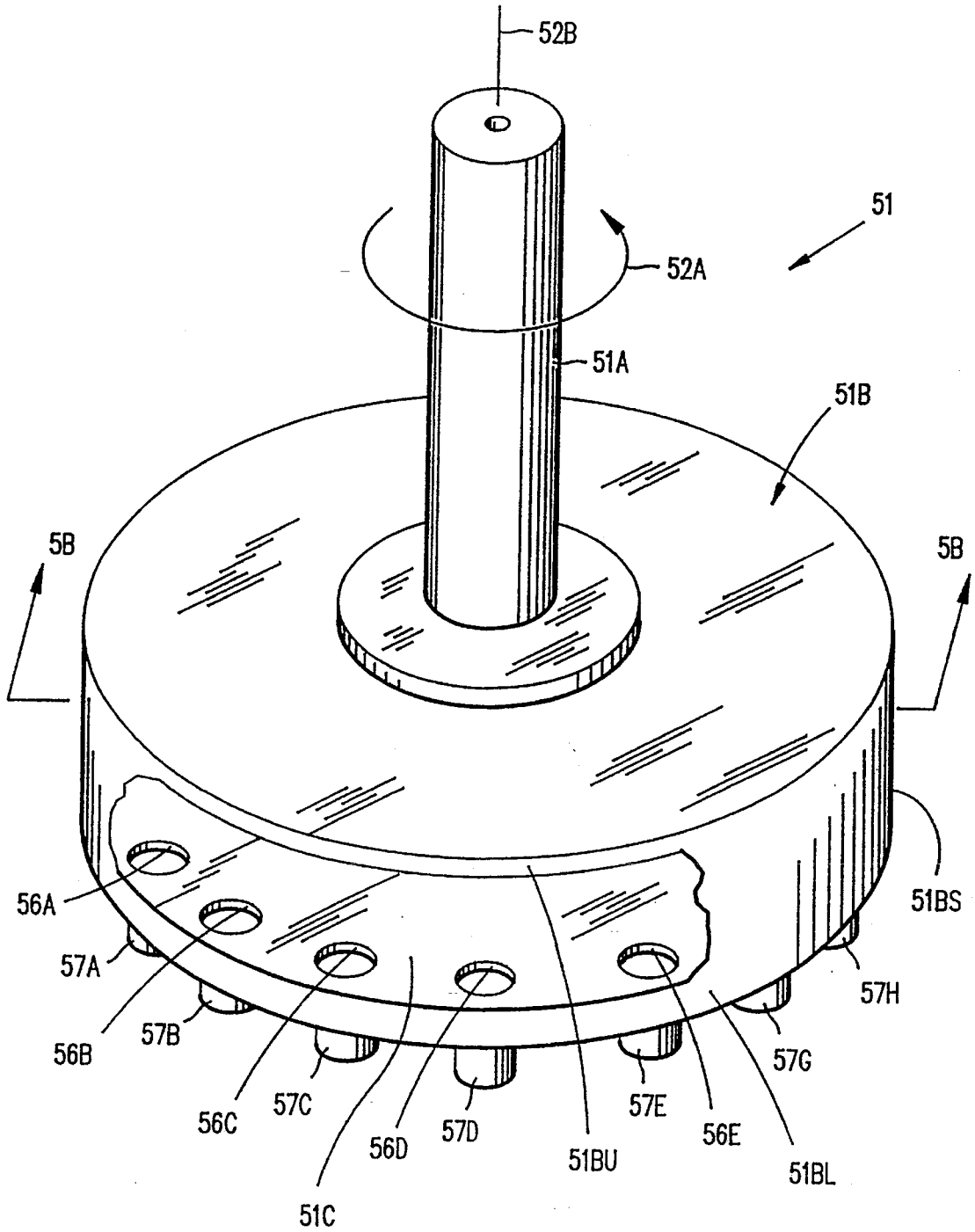
FIG. 5A illustrates an isometric view of another embodiment of a polishing wheel which operates in accordance with the invention illustrated in FIG. 4.
Figure 9:
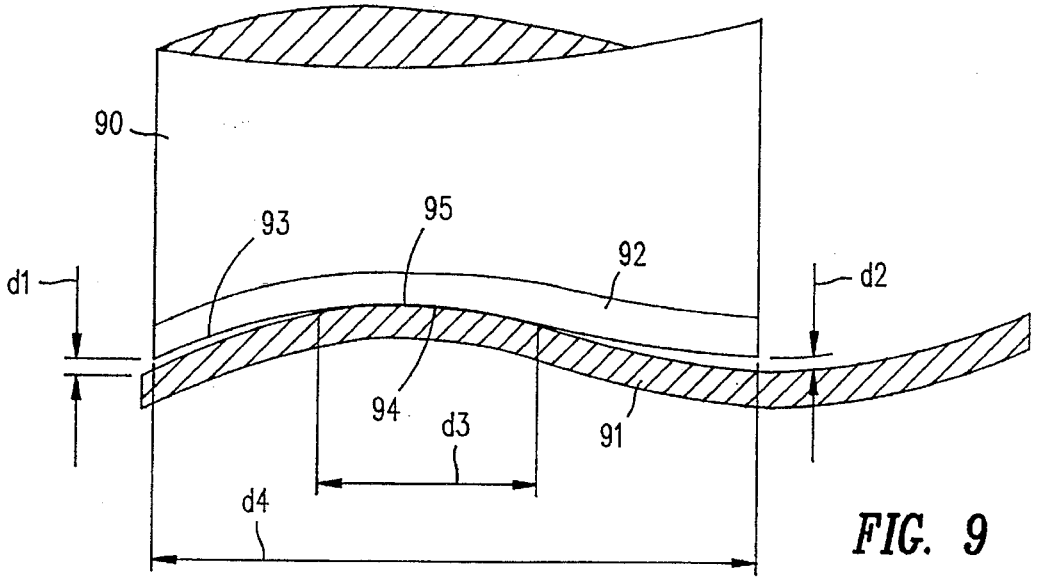
FIG. 9 illustrates a block in accordance with this invention, in contact with a portion of a wafer.

FIG. 5A is an isometric view of one embodiment of a polishing wheel 51 in accordance with this invention. Central shaft 51A of polishing wheel 51 is rotated on the vertical axis by a motor (such as motor 40P of FIG. 4 although motor 40P is shown for rotating a wafer in FIG. 4). Central shaft 51A drives a housing 51B which has a chamber 51C formed by upper wall 51BU, lower wall 51BL and side wall 5lBS. Lower wall 51BL has a number of hydraulic cylinders, such as hydraulic cylinders 56A, 56B, 56C, 56D, and 56E in which are supported cylindrical blocks such as blocks 57A, 57B, 57C, 57D, 57E, 57G and 57H (collectively referred to as blocks 57), which act as pistons of the hydraulic cylinders. Blocks 57 are made of porous urethane or another common polishing pad material. Although cylindrical blocks are illustrated in FIG. 5A, a block in accordance with this invention can have any shape, as illustrated, for example in FIGS. 8A–8D. Moreover, although the entire block can be made of urethane, a block can be a composite having a solid body with a layer of urethane 92 for the eroding surface (FIG. 9).

Figure 5B:
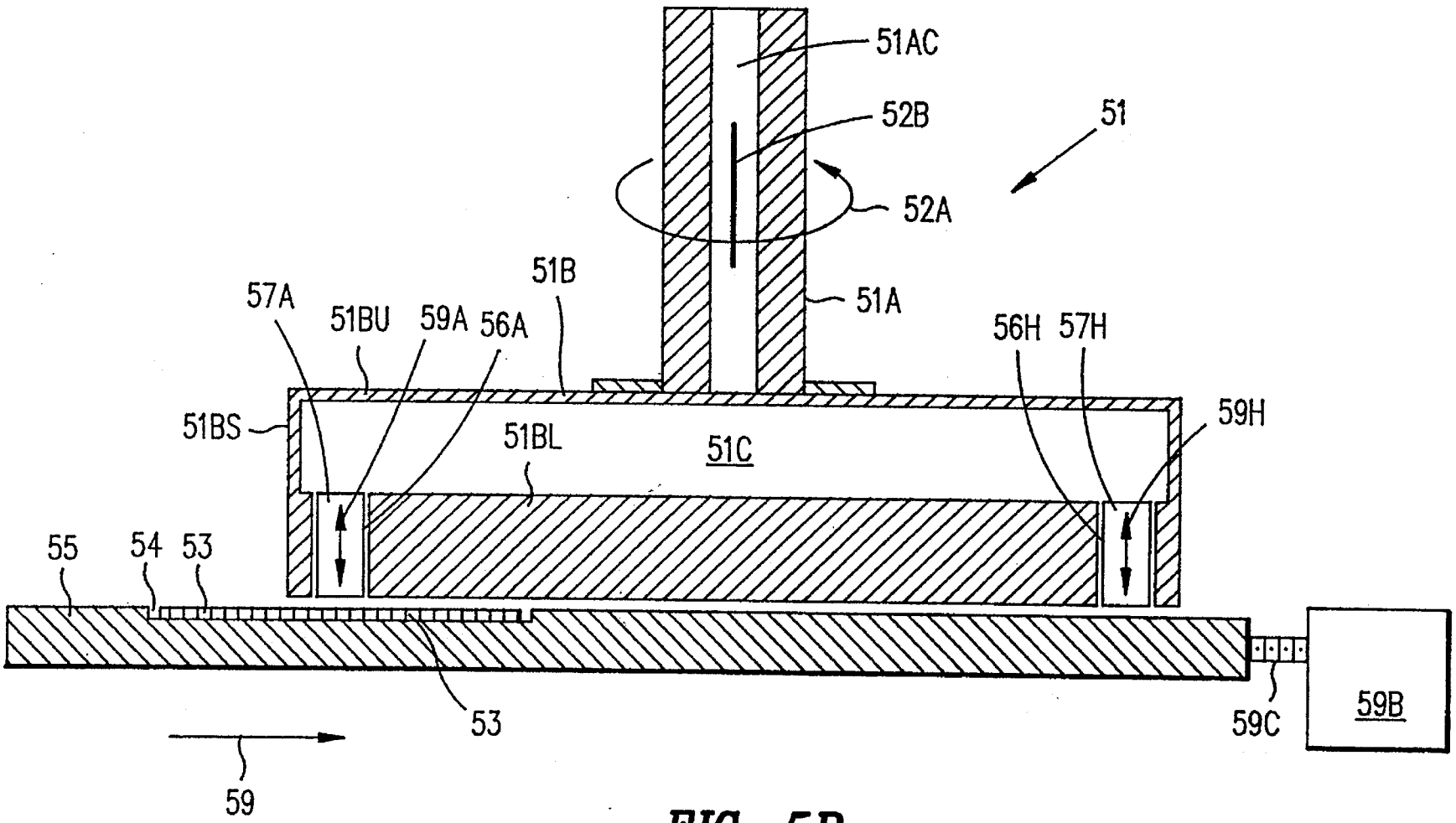
FIG. 5B is a cross sectional view of the polishing wheel of FIG. 5A.

FIG. 5B is a cross-sectional view along direction 5B—5B of polishing wheel 51 depicted in FIG. 5A. The blocks of polishing wheel 51 are reciprocally mounted in housing 51B so as to freely reciprocate in a direction generally perpendicular to lower wall 51BL, and generally perpendicular to the surface of wafer 53, for example in directions 59A and 59H. The reciprocable mounting of blocks allows each block to follow the curvature of the wafer independent of adjacent blocks, as described above in reference to FIG. 4.

A channel 51AC within central shaft 51A connects to chamber 51C. When a pressurized fluid such as air or a liquid is injected into channel 51AC by means of a slip ring (not shown), pressure builds up in chamber 51C. This pressure forces blocks 57 against a wafer 53 with a force equal to the air or liquid pressure. Although blocks 57 are shown being forced by a fluid, blocks 57 can be forced by other means such as springs, screws and other mechanical devices, as long as the axial force exerted on a block, for example along direction 59A, is independent of the axial force exerted on another block, for example along direction 59H and is substantially unaffected by the shear force exerted on the block due to the relative motion between the block and the wafer, so that the eroding surface of the block remains substantially parallel to the portion of the wafer surface in contact with the block.

Figure 5C:
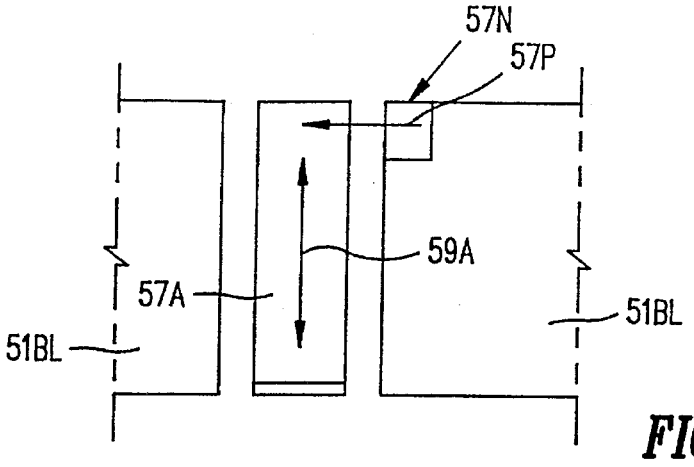
FIG. 5C illustrates a spin prevention pin that keeps a block from spinning during relative motion between a wafer and a block in accordance with this invention.

In the embodiment of FIG. 5A, blocks 57 are substantially unaffected by shear forces because blocks 57 are constrained by the walls of hydraulic cylinder formed in lower wall 51BL. Moreover, blocks 57 are rotated by polishing wheel 51 around axis 52B as shown by arrow 52A. Due to the relative motion between wafer 53 and blocks 57, blocks 57 may spin along their respective central axes, if blocks 57 are unconstrained. Any spinning of a block about the blocks axis is undesirable because of nonuniform polishing rate across the eroding surface of the block. Therefore, in accordance with this invention, any spinning motion of blocks 57 is prevented by use of spin prevention means such as a pin 57P (FIG. 5C) and a notch 57N which only permits longitudinal motion of blocks 57 for example along directions 59A and 59H. If blocks 57 are blocks of a square or rectangular cross section, the pin 57P serves to simply limit the longitudinal motion within a given range, for example so blocks do not fall out of housing 51, when housing 51 is lifted above wafer support arm 55.

Wafer 53, with photolithographic images (not shown in FIG. 5B) is held in groove 54 formed in a wafer support arm 55, driven by a transverse slide mechanism made up of lead screw 59C and motor 59B.

In the embodiment of FIGS. 5A and 5B, wafer 53 is moved at a uniform horizontal speed in direction 59 in a plane perpendicular to central axis 52B of polishing wheel 51 until all parts of wafer 53 have crossed the circular path of blocks 57, so that blocks 57 uniformly remove all the protrusions of the photolithographic images of wafer 53.

A polishing apparatus in accordance with this invention can provide any type of relative motion between a wafer and the blocks, such as linear motion, circular motion, vibrational motion and orbital motion.

Figure 6A:
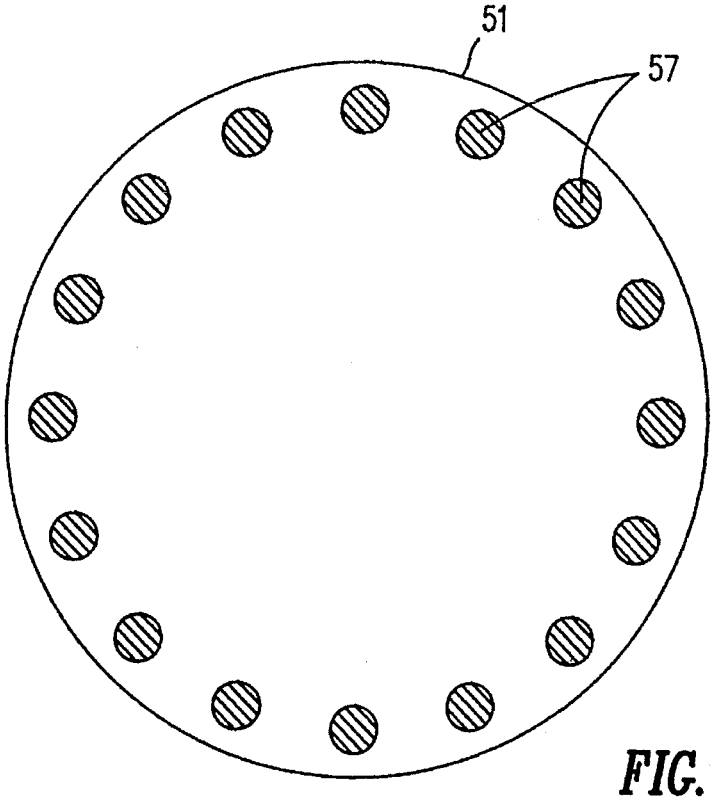
FIGS. 6A, 6B, and 6C illustrate three embodiments of a polishing wheel in accordance with this invention.

In accordance with this invention, the design of a housing that supports the blocks is optimized to fit the wafer or other workpiece shape to include the maximum number of blocks without sacrificing uniformity. FIG. 6A shows a bottom view of the polishing wheel 51 described in reference to FIG. 5A and FIG. 5B. In this embodiment, blocks 57 are reciprocably mounted in hydraulic cylinders adjacent to the periphery of polishing wheel 51.

Figure 6B:
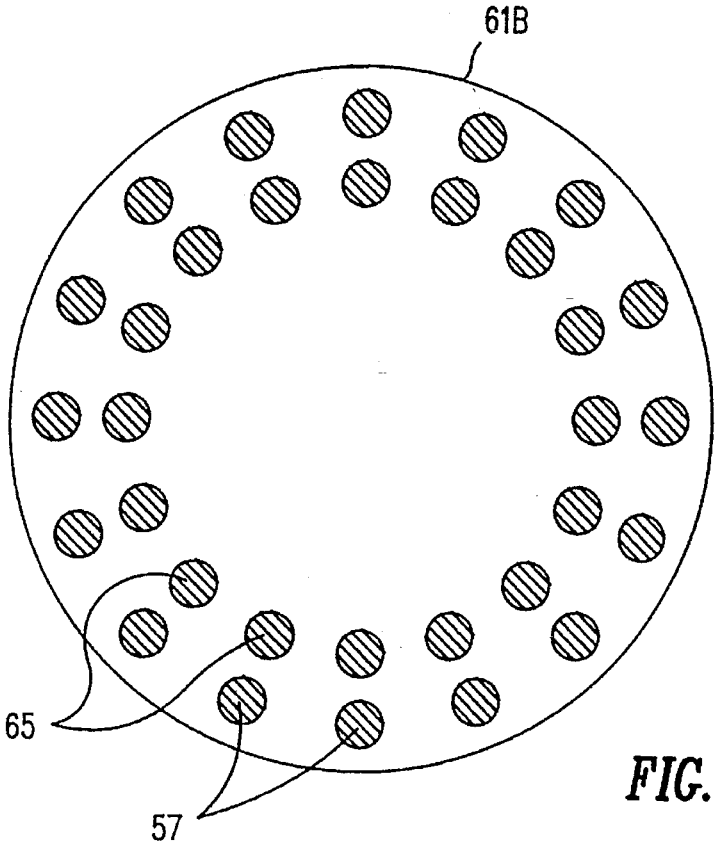

FIG. 6B shows a polishing wheel 61B with a second row of blocks 65 interior to blocks 57 of polishing wheel 51 shown in FIG. 6A. The second row of blocks 65 has been added to significantly increase the polishing rate of polishing wheel 61B over the polishing rate of polishing wheel 51. In accordance with this invention, any number of blocks can be arranged in any number of concentric circles as long as the inner row has a diameter larger than the wafer's diameter, so that all parts of a wafer can completely pass underneath the path of blocks so as to cause uniform polish removal across the surface of the wafer.

In one embodiment, each of blocks 57 arranged in the outer circle in FIG. 6B is arranged along a radial line, in line with and passing through one of blocks 65, arranged in the inner circle in FIG. 6B. In another embodiment, each of blocks 57 as is arranged along a radial line which is staggered from a radial line passing through one of blocks 65. An advantage of the staggered arrangement is that a larger number of blocks can be accommodated in the same unit area as compared to the inline arrangement.

Figure 6C:
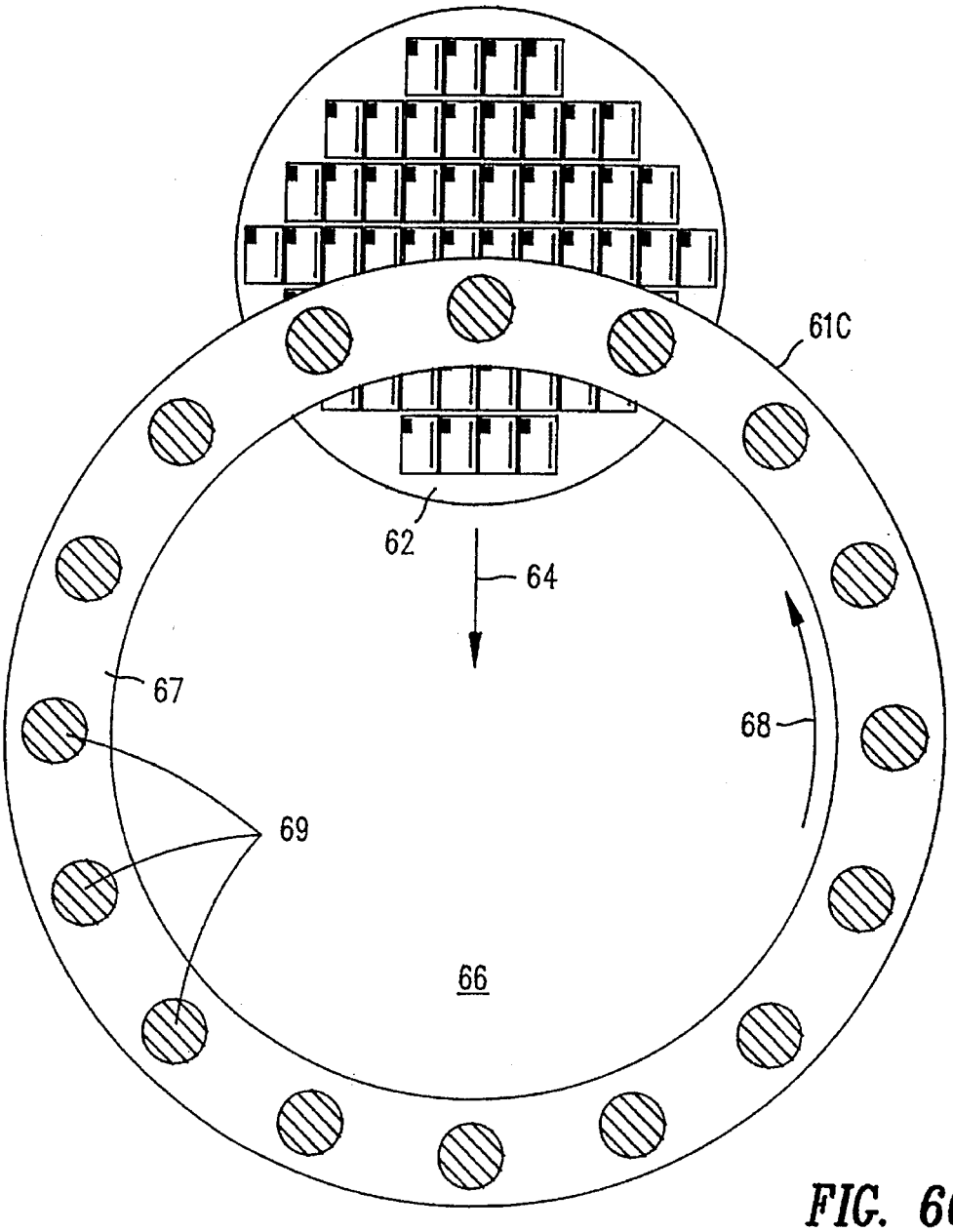

FIG. 6C shows a polishing wheel 61C of carousel design with an open center housing 67 which holds a single or multiple of rows of blocks 69. Wafer 62 passes under the ring of blocks as shown by arrow 64. Polishing of the wafer surface occurs when housing 67 rotates as shown by arrow 68. As wafer 62 passes underneath housing 67 into open central area 66 endpoint of the polishing process is measured using optical absorption or other methods known to those skilled in this art.

A polishing block in accordance with this invention can be formed of a very hard polishing material that is of sufficient thickness so that the surface of the material does not distort into the microstructure of a integrated circuit, thereby accomplishing a significant improvement in local planarization. For example, boron silicate glass or silica having a modulus of elasticity of approximately 10,000,000 psi can be used to form an eroding surface of a block in accordance with this invention. Also, a block's eroding surface can be formed, for example, of solid polymer having a modulus of elasticity of 500,000 psi. A softer eroding surface can be used for photolithographic images having a large number of regions of slow material removal to support the eroding surface, while the harder eroding surface is preferable for images having a single region or two regions of slow material removal.

This invention also allows the blocks to last much longer than a traditional polishing pad. Wear of the block does not affect local uniformity unlike use of a thin polishing pad. Lifetime of the block is increased significantly over traditional polishing pads, depending on the length of the block.

Figure 7A:
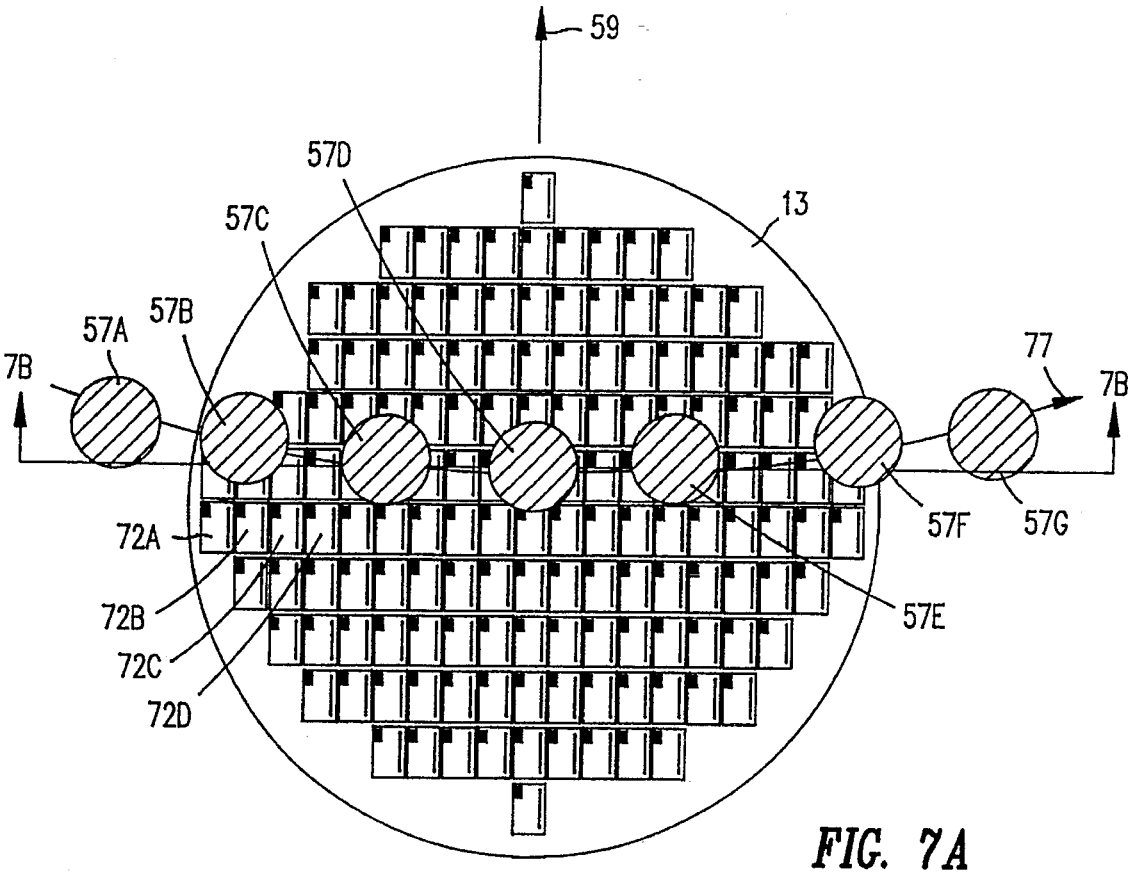
FIG. 7A illustrates a relationship between the size of a block and a wafer in accordance with this invention.

FIG. 7A illustrates the relationship, in accordance with this invention, between the size of blocks 57A, 57B, 57C, 57D, 57E, 57F, 57G and a wafer 13. Each of blocks 57A, 57B, 57C, 57D, 57E, 57F, 57G cover a few integrated circuit die, in this embodiment, averaging three die of wafer 13. The arc of each of blocks 57A, 57B, 57C, 57D, 57E, 57F, 57G as each block moves across wafer 13 is shown by arrow 77.

Figure 7B:
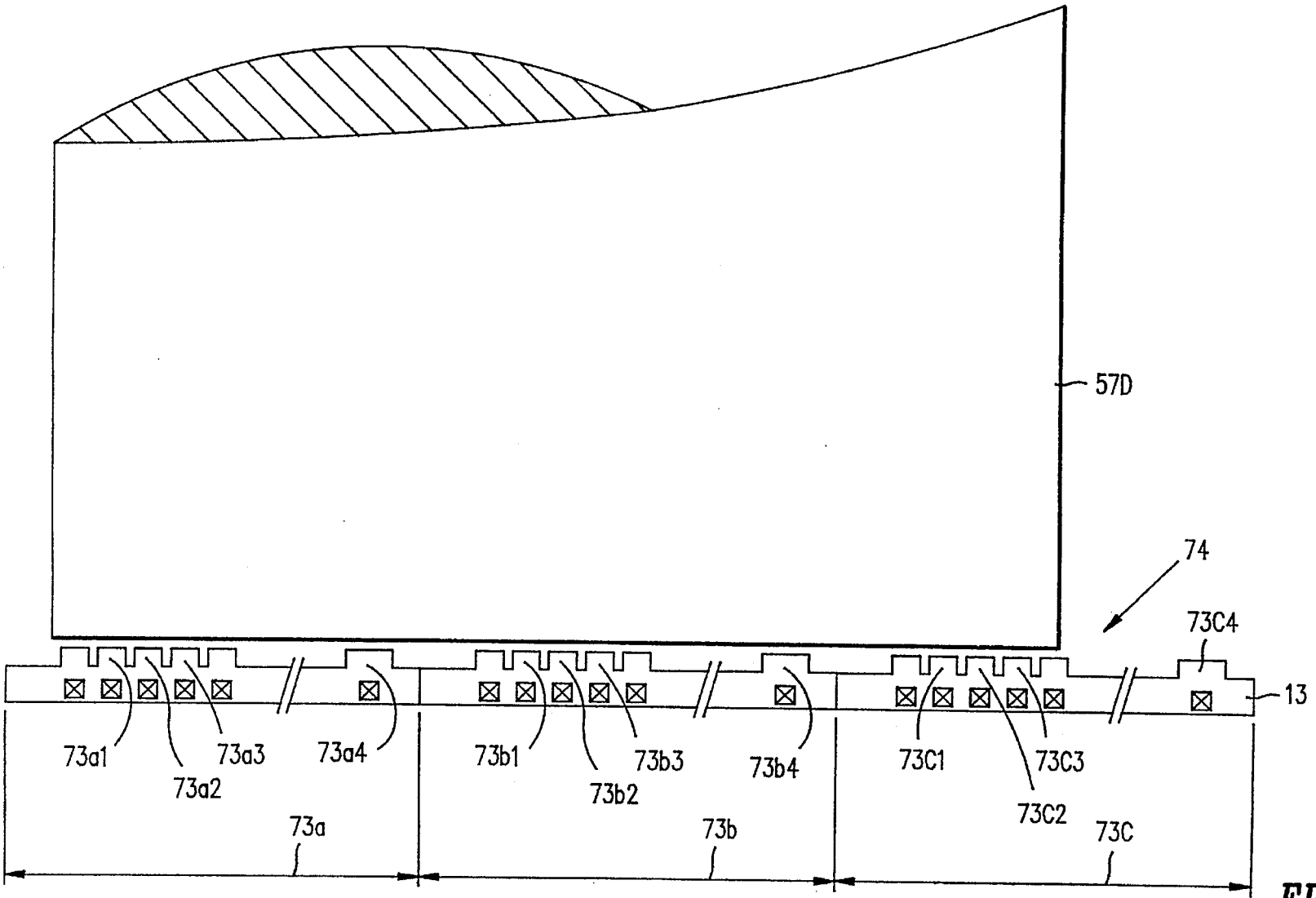
FIG. 7B is a cross sectional view of block 57D and the corresponding parts of the wafer taken along line 7B—7B in FIG. 7A.

A cross-sectional view of block 57D and a portion of wafer 13 beneath block 57D (taken along line 7B—7B of FIG. 7A) is shown in FIG. 7B. This view is taken as block 57D crosses over the surface of photolithographic images 73*a*, 73*b* and 73*c*. The most dense and therefore the slowest polishing region of image 73*a* includes protrusions 73*a*1, 73*a*2 and 73*a*3, covering for example, a SRAM or other memory circuit. The fastest polishing area includes protrusion 73*a*4 covering for example, an isolated wiring line. For adjacent photolithographic images 73*b* and 73*c*, the slowest polishing regions include protrusions 73*b*1, 73*b*2, 73*b*3, 73*c*1, 73*c*2, 73*c*3 and fast polishing areas include protrusions 73*b*4 and 73*c*4 respectively.

In the embodiment of FIGS. 7A and 7B, each of blocks 57A, 57B, 57C, 57D, 57E, 57F has a circular eroding surface with a diameter approximately three times the size of a lateral side of photolithographic image of wafer 13. The dense, slower polishing regions including protrusions 73*a*1, 73*a*2, 73*a*3, 73*b*1, 73*b*2, 73*b*3, 73*c*1, 73*c*2, 73*c*3 support block 57D during polish so that faster polishing areas which include protrusions 73*a*4, 73*b*4 and 73*c*4 polish at a slower rate than with conventional polishing pads, of larger or smaller sizes.

In this embodiment, block 57D is supported by protrusions of at least one slow polishing area in each of three adjacent photolithographic images at a given instant, as block 57D slides across wafer surface 74. A block smaller than block 57D that touches only two images tilts or distorts during movement and the polishing rate increases for the faster polishing area protrusion, thereby resulting in poorer local uniformity.

FIGS. 8A–8D depict photolithographic images found on the surface of a wafer in relation to the outline of the eroding surface contact area of one embodiment in accordance with this invention. Protrusions covering dense wiring areas, such as dense wiring areas 93, 94 and 95 are polished slower than a protrusion covering an isolated line 104. In accordance with this invention, as a block slides over the surface of a wafer, the block is continuously supported by at least slow polishing protrusions covering three dense wiring areas which form a triangle of support so the block remains parallel to the wafer surface.

Figure 8A:
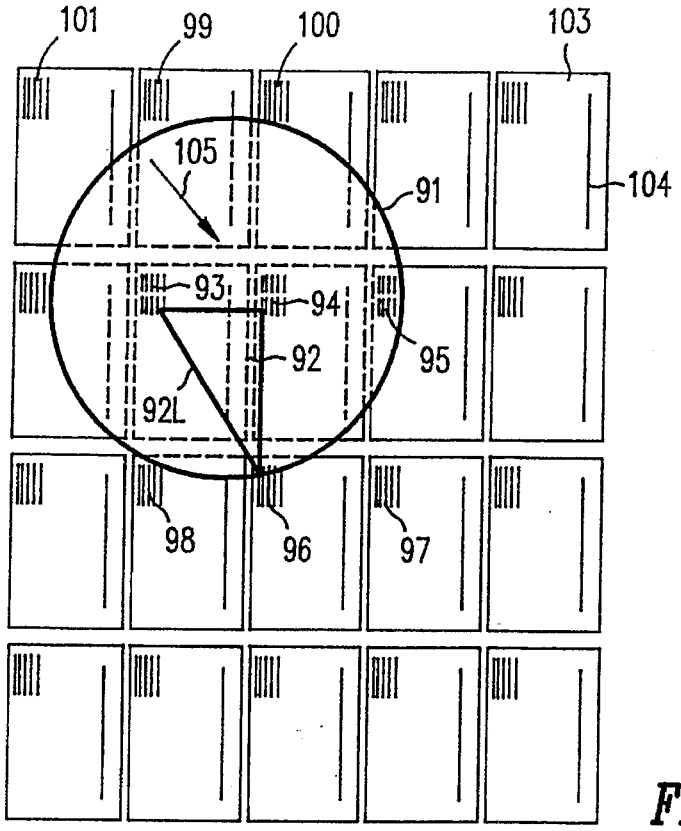
FIGS. 8A–8D depict photolithographic images found on the surface of a wafer in relation to the outline of an eroding surface of one embodiment of a block in accordance with this invention.

In FIG. 8A block 91 moves in the direction shown by arrow 105. In the previous instant, block 91 was supported by protrusions over dense wiring areas 99, 100, 101, 93, 94 and 95. As block 91 leaves the protrusions over dense wiring areas 99, 100 and 101, a leading side of block 91 encounters protrusions over dense wiring areas 96, 97 and 98. Protrusions over dense wiring area 96 replace support of block 91 by protrusions over dense wiring area 100, thereby preventing block 91 from tilting. The eroding surface of the block stays parallel to the wafer surface at all times because the block is supported by the triangle of support, thus avoiding problems due to tilt of a block. As protrusions included in three slowest polishing regions always provide a triangle of support for block 91, block 91 is stable at all times while block 91 moves over the wafer.

In one embodiment, eroding surface of block 91 has a diameter approximately twice the largest side 92L of triangle 92. Triangle 92 is the largest possible triangle having three slow polishing regions at the corners and excluding other slow polishing regions. The diameter described above ensures that as the block leaves one triangle of support during relative movement, another triangle of support is formed, thus ensuring at least one triangle of support at all times.

Although a larger block with more points of support appears more stable, yet as the block gets larger, global polishing removal uniformity is adversely impacted. Therefore, a block in accordance with this invention has a minimum area necessary to contact a few slow polishing regions simultaneously, at all times during movement of the block across the wafer. As three points determine a plane, there must be a minimum of three slow polishing regions forming a triangle of support at all times during the block's movement relative to the wafer.

Figure 8B:
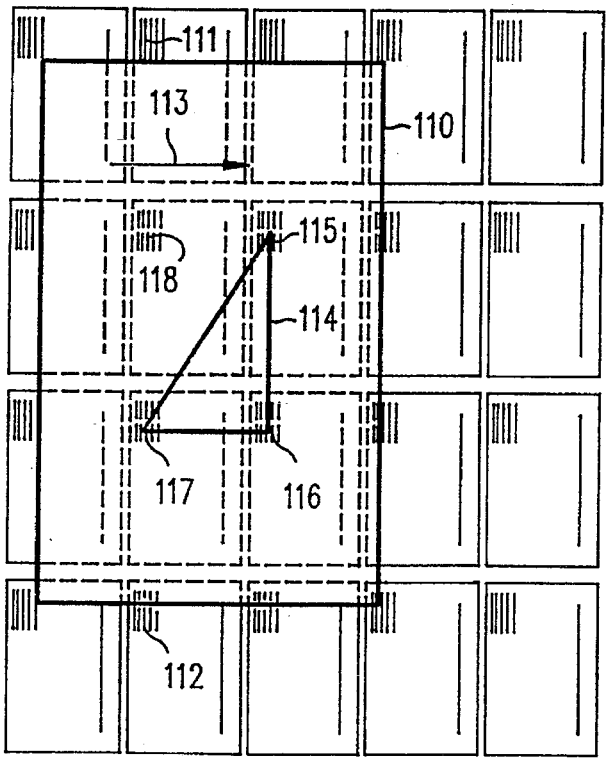

Although FIG. 8A illustrates a circular block, which is the easiest shape for fabricating a block, a seal and the hydraulic cylinder, other shapes can have advantages depending on the situation. FIG. 8B depicts a rectangular polishing block 110. A rectangular shape maximizes the block's stability over rectangular die, especially if the path the block takes across the wafer is linear and parallel to the wafer die patterns. As the rectangular polishing block follows the trajectory indicated by arrow 113, dense wiring areas such as areas 115, 116 and 114 form a triangle of support, such as triangle 114. In this design, the minimum amount of support is offered by slow polishing protrusions over areas 115, 116, 117 and 118 to stabilize polishing block 110. There are always four slow polishing regions of support underneath block 110 because of the repeating pattern of the slowest polishing regions of the photolithographic images on the wafer.

Figure 8C:
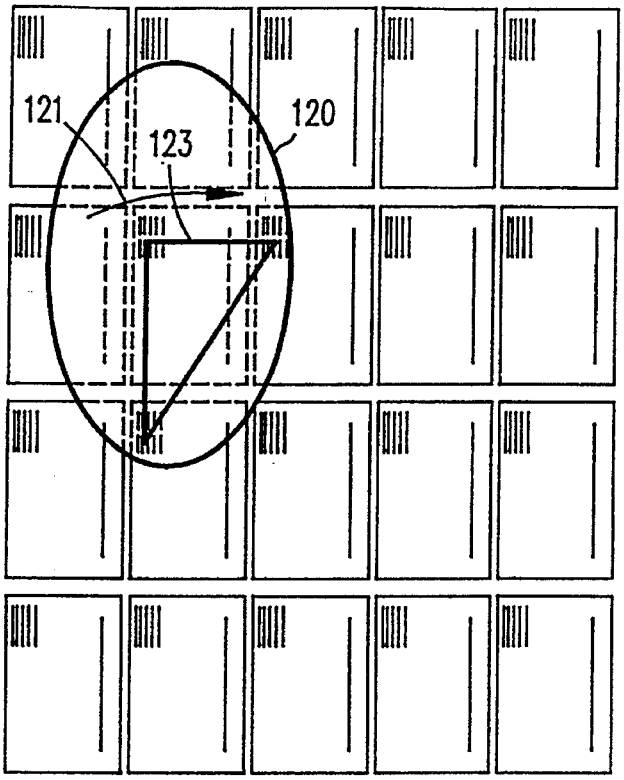

FIG. 8C illustrates an oval shaped polishing block 120 covering a minimal area while providing good stability by triangles of support, such as triangle 123. The oval polishing block 120 is useful when the arc of travel 121 is small, and rectangular die are formed in the wafer. The oval shape adapts to the rectangular nature of the die, and yet allows the ease of fabrication similar to a circular block.

Figure 8D:
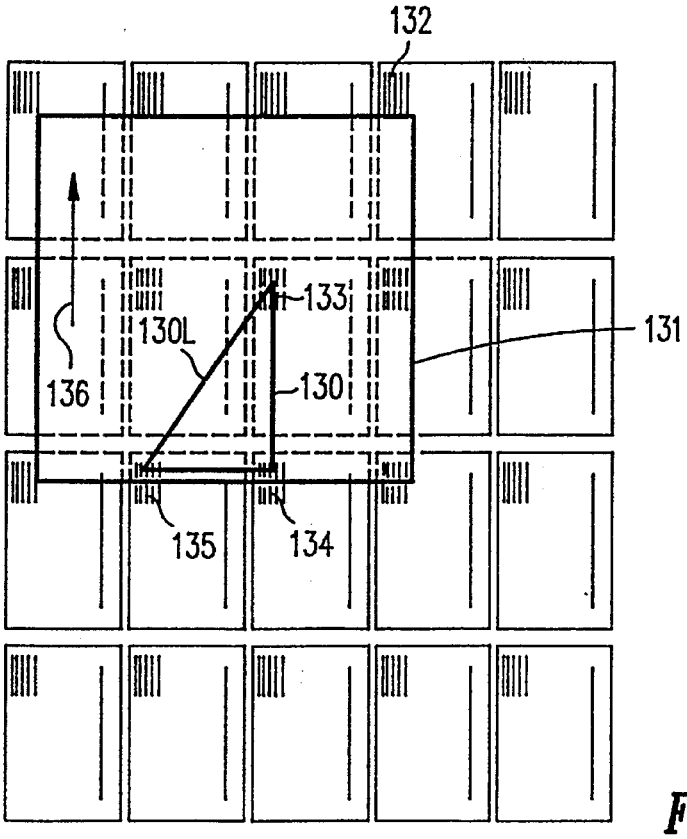

FIG. 8D illustrates a square block 131. The square shape is more useful when the integrated circuit die are also square. The minimum size for the square block 136 is the size of six die because block 131 must have a size twice side 130L of triangle 130 so that block 131 contacts slow polishing protrusions over area 132 as the block leaves slow polishing protrusions over area 135 while traveling in direction 136.

Although certain block shapes have been described, a polishing block in accordance with this invention can have any regular or irregular shape depending on the situation.

In a preferred mode of operation, the blocks are passed over an abrading surface before the blocks contact the wafer or workpiece. The abrading surface provides a small amount of abrasion to the eroding surface. The action of the abrading surface trues the eroding surface of the block to be parallel to wafer support arm 55 of FIG. 5B. The action of the abrading surface allows the tip of the block to be trued under load, allowing correct compensation for the dynamic shear force on the tip of the block.

Polishing blocks such as those depicted in FIG. 8A, 8B, 8C and 8D or polishing blocks of other structure designed to contact the surface of a wafer for a contact area approximately the size of three or four die are a substantial improvement over the prior art for the following reasons. The blocks are always stable because of the triangle of support formed by slow polishing area protrusions. Therefore, local polish removal uniformity is maximized by using a very hard eroding surface. Also global polish removal uniformity is not significantly compromised by the hard eroding surface because of the small size of the block eroding surface in relation to the curvature of the wafer, as discussed below.

FIG. 9 illustrates a block 90 in accordance with this invention in contact with a portion of wafer 91. Although block 90 is not very hard due to its modulus of elasticity, block 90 has a very hard eroding surface 92 that has a curvature 93. Although curvature 93 conforms to curvature 94 of wafer 91 in the block's central region 95, curvature 93 deviates from curvature 94 by a distance d1 at one edge and by a distance d2 at another edge of block 90.

A deviation of block 90 is minimized by using the smallest eroding surface possible for block 90. However, as the area of eroding surface of block 90 is reduced, the overall polishing rate is reduced because of the smaller area of block 90 rubbing on wafer 91. Therefore in some applications, to obtain commercially viable speeds it is necessary to choose an eroding surface having an area larger than the smallest possible area for providing a triangle of support.

However, in accordance with this invention, the eroding surface of a block should have an area no larger than the area sufficient for the eroding surface to remain in contact with all protrusions enclosed by the area, prior to relative motion between the wafer and the block. For example, in FIG. 9, the block's eroding surface can have a diameter no larger than d3 for block 90 to maintain contact with every protrusion covered by block 90. In some cases, where maximum local uniformity is desired, the block maintains contact with the entire top surface of every protrusion enclosed by the area of the erosion surface of the block. When the eroding surface contacts all protrusions covered by the eroding surface prior to relative motion, then the polishing of all protrusions begins simultaneously.

If the block is larger, then protrusions covering some die will be polished faster because of the total contact area, than protrusions in adjacent die. The polish rate is not as large as in the conventional polishing pads because of smaller total contact area. Also, the block can exert different pressure on different protrusions. For example the block can exert higher pressure in a central protrusion around area 95 and a lower pressure on protrusions near the block's edges. In such cases, a smaller area must be chosen for the eroding surface such that the curvature of the eroding surface deviates from the global curvature of the wafer only by a predetermined amount which is specific to the manufacturing process of the wafer. For example, the larger of deviations d1 and d2 should be no larger than 1000 Å for a 0.7 CMOS logic process even if block 90 is soft enough for block 90 to maintain contact with every protrusion within the circle of diameter d4.

In specific one embodiment, a block has a diameter of 1½ inches (three times the side of a ½ inch square die including the kerf area between adjacent die), a length of 2 inches. A smaller length reduces friction between the cylindrical wall of the block and the wall of the hydraulic cylinder. The whole block is made of urethane, such as IC 60 or IC 1000 available from Rodel, Inc. 9495 East San Salvador Drive, Scottsdale, Ariz. 85258.

Although the present invention has been described in connection with the above described illustrative embodiments, the present invention is not limited thereto. For example, a block in accordance with this invention can be used in any conventional apparatus or process, such as, a polishing head as described in U.S. Pat. No. 5,230,184 to Bukhman, or as tiles of U.S. Pat. No. 5,212,910 to Breivogel et al., or in the wafer polishing equipment of Beppu et al. described in "A new pad and equipment development for ILD planarization" referenced above, instead of the polishing apparatus illustrated in FIGS. 5A, 5B, 6A–6D described above.

Although the word "block" has been used in the enclosed description, the invention can be applied to any similar part of a polishing apparatus such as rod, pad and tile.

Also, a liquid slurry containing abrasive particles can be used between the wafer and the blocks in a polishing apparatus in accordance with this invention.

Moreover, although a block's eroding surface described above can be made of boron silicate glass, silica and a solid polymer, other materials such as aluminum oxide, diamond and silicon dioxide can also be used in accordance with this invention.

Furthermore, a polishing apparatus in accordance with this invention can be used with any conventional block of any size, such as blocks of the size of one die.

Moreover, although each of the slow polishing regions of a wafer have been illustrated as being one slow polishing region per photolithographic image, there can be any number of slow polishing regions within a photolithographic image, thereby allowing blocks of smaller eroding surfaces than a photolithographic image to be used in accordance with this invention, as long as the block is supported by three slow polishing regions in a triangle of support during all relative movement between the block and the wafer.

Although the above description refers to a wafer having identical repeating photolithographic images, the invention is also applicable to wafers having a plurality of nonidentical photolithographic images wherein the triangle of support is the largest triangle on the wafer which does not include a fourth slow polishing region, other than the three supporting slow polishing regions at the triangle's corners.

Various modifications and adaptations of the above discussed embodiments are encompassed by this invention as set forth in the appended claims.

I claim:

1. An apparatus for removing a portion of a wafer, said apparatus comprising:

a plurality of blocks reciprocally mounted such that an eroding surface of each block of said plurality of blocks is parallel to a surface of said wafer in contact with said plurality of blocks;

means for forcing each of said blocks against said wafer, wherein said means for forcing exerts a first force on a first block of said plurality of blocks and said means for forcing exerts a second force on a second block of said plurality of blocks such that said first force and said second force are independent of each other; and means for causing relative motion between said plurality of blocks and said wafer, said apparatus removing a portion of said wafer during said relative motion;

wherein the eroding surface of each of said blocks has an area sufficient for said block to be supported by three regions on said wafer, each region having the slowest rate of material removal in said wafer.

2. The apparatus of claim 1 wherein said means for forcing comprises a fluid, said fluid applying a pressure on each of said blocks.

3. The apparatus of claim 2 wherein said fluid is a magnetic fluid and wherein said housing comprises means for applying a magnetic force on said magnetic fluid such that said blocks are forced against said wafer during said relative motion between said block and said wafer.

4. The apparatus of claim 1 wherein said plurality of blocks are arranged around a circle.

5. The apparatus of claim 4 wherein a first number of said blocks are arranged equidistant from each other on a first circle, and a second number of said blocks are arranged on a second circle, said second circle being concentric to said first circle.

6. The apparatus of claim 5 wherein said first number is greater than or equal to said second number and wherein each block of said second circle is arranged along a radial line passing through one of said blocks on said first circle and the center of said first circle.

7. The apparatus of claim 1 wherein each of said blocks has the shape of a circle.

8. The apparatus of claim 1 wherein each of said blocks has the shape of a square.

9. The apparatus of claim 1 wherein each of said blocks has the shape of a rectangle.

10. The apparatus of claim 1 wherein each of said blocks has the shape of an ellipse.

11. The apparatus of claim 1 wherein said means for causing relative motion causes linear motion between said wafer and said block.

12. The apparatus of claim 1 wherein said means for causing relative motion causes said plurality of blocks to rotate and causes said wafer to translate along a radial direction at a uniform speed.

13. The apparatus of claim 1 wherein said means for causing relative motion causes circular motion between said wafer and said plurality of blocks.

14. The apparatus of claim 1 wherein said means for causing relative motion causes vibrational motion between said wafer and said plurality of blocks.

15. The apparatus of claim 1 wherein said means for causing relative motion causes orbital motion between said wafer and said block.

16. The apparatus of claim 1 wherein said eroding surface of each of said blocks has a modulus of elasticity between approximately 10 million psi and approximately 500,000 psi.

* * * * *